US010094392B2

(12) United States Patent
Poulton et al.

(10) Patent No.: US 10,094,392 B2
(45) Date of Patent: Oct. 9, 2018

(54) FAN ASSEMBLY

(71) Applicant: Dyson Technology Limited, Wiltshire (GB)

(72) Inventors: Roy Edward Poulton, Malmesbury (GB); Alan Howard Davis, Malmesbury (GB); Joseph Eric Hodgetts, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 866 days.

(21) Appl. No.: 13/683,281

(22) Filed: Nov. 21, 2012

(65) Prior Publication Data

US 2013/0323100 A1 Dec. 5, 2013

(30) Foreign Application Priority Data

Nov. 24, 2011 (GB) ..... 1120268.6

(51) Int. Cl.
*F04D 29/54* (2006.01)
*F04F 5/16* (2006.01)
(Continued)

(52) U.S. Cl.
CPC ..... *F04D 29/54* (2013.01); *F04D 25/06* (2013.01); *F04D 25/08* (2013.01); *F04D 27/002* (2013.01);
(Continued)

(58) Field of Classification Search
CPC ..... F04F 5/16; F04F 5/46; F24F 7/065; F04D 25/08; F04D 29/54; F04D 27/002; F04D 25/06; F04D 29/522
See application file for complete search history.

(56) References Cited

U.S. PATENT DOCUMENTS 284,962 A 9/1883 Huston
1,357,261 A 11/1920 Svoboda
(Continued)

FOREIGN PATENT DOCUMENTS

BE 560119 8/1957
CA 1055344 5/1979
(Continued)

OTHER PUBLICATIONS

Machine Translation of WIPO publication WO 2011129073 A1 to Kato et al.*
(Continued)

*Primary Examiner* — Peter J Bertheaud
*Assistant Examiner* — Dnyanesh Kasture
(74) *Attorney, Agent, or Firm* — Morrison & Foerster LLP

(57) ABSTRACT

A nozzle for a fan assembly includes an air inlet, an air outlet, an interior passage for conveying air from the air inlet to the air outlet, an annular inner wall, and an outer wall extending about the inner wall. The interior passage is located between the inner wall and the outer wall. The inner wall at least partially defines a bore through which air from outside the nozzle is drawn by air emitted from the air outlet. A flow control port is located downstream from the air outlet. A flow control chamber is provided for conveying air to the flow control port. A control mechanism selectively inhibits a flow of air through the flow control port to deflect an air flow emitted from the air outlet.

18 Claims, 9 Drawing Sheets

(51) Int. Cl.

| | |
|---|---|
| ***F04D 25/08*** | (2006.01) |
| ***F04F 5/46*** | (2006.01) |
| ***F04D 27/00*** | (2006.01) |
| ***F24F 7/06*** | (2006.01) |
| ***F04D 25/06*** | (2006.01) |
| ***F04D 29/52*** | (2006.01) |

(52) U.S. Cl.
CPC ..... *F04D 29/522* (2013.01); *F04F 5/16* (2013.01); *F04F 5/46* (2013.01); *F24F 7/065* (2013.01)

(56) References Cited

U.S. PATENT DOCUMENTS

| | | | | |
|---|---|---|---|---|
| 1,767,060 | A | | 6/1930 | Ferguson |
| 1,896,869 | A | | 2/1933 | Larsh |
| 2,014,185 | A | | 9/1935 | Martin |
| 2,035,733 | A | | 3/1936 | Wall |
| 2,071,266 | A | | 2/1937 | Schmidt |
| D103,476 | S | | 3/1937 | Weber |
| 2,115,883 | A | | 5/1938 | Sher |
| D115,344 | S | | 6/1939 | Chapman |
| 2,210,458 | A | | 8/1940 | Keilholtz |
| 2,258,961 | A | | 10/1941 | Saathoff |
| 2,295,502 | A | | 9/1942 | Lamb |
| 2,336,295 | A | | 12/1943 | Reimuller |
| 2,363,839 | A | | 11/1944 | Demuth |
| 2,433,795 | A | | 12/1947 | Stokes |
| 2,473,325 | A | | 6/1949 | Aufiero |
| 2,476,002 | A | | 7/1949 | Stalker |
| 2,488,467 | A | | 11/1949 | De Lisio |
| 2,510,132 | A | | 6/1950 | Morrison |
| 2,544,379 | A | | 3/1951 | Davenport |
| 2,547,448 | A | | 4/1951 | Demuth |
| 2,583,374 | A | | 1/1952 | Hoffman |
| 2,620,127 | A | | 12/1952 | Radcliffe |
| 2,692,800 | A | * | 10/1954 | Nichols et al. ..... 137/14 |
| 2,711,682 | A | | 6/1955 | Drechsel |
| 2,765,977 | A | | 10/1956 | Morrison |
| 2,808,198 | A | | 10/1957 | Morrison |
| 2,813,673 | A | | 11/1957 | Smith |
| 2,830,779 | A | | 4/1958 | Wentling |
| 2,838,229 | A | | 6/1958 | Belanger |
| 2,922,277 | A | | 1/1960 | Bertin |
| 2,922,570 | A | | 1/1960 | Allen |
| 3,004,403 | A | | 10/1961 | Laporte |
| 3,047,208 | A | | 7/1962 | Coanda |
| 3,270,655 | A | | 9/1966 | Guirl et al. |
| D206,973 | S | | 2/1967 | De Lisio |
| 3,503,138 | A | | 3/1970 | Fuchs et al. |
| 3,518,776 | A | | 7/1970 | Wolff et al. |
| 3,724,092 | A | | 4/1973 | McCleerey |
| 3,729,934 | A | | 5/1973 | Denning et al. |
| 3,743,186 | A | | 7/1973 | Mocarski |
| 3,795,367 | A | | 3/1974 | Mocarski |
| 3,872,916 | A | | 3/1975 | Beck |
| 3,875,745 | A | | 4/1975 | Franklin |
| 3,885,891 | A | | 5/1975 | Throndson |
| 3,943,329 | A | | 3/1976 | Hlavac |
| 4,037,991 | A | | 7/1977 | Taylor |
| 4,046,492 | A | | 9/1977 | Inglis |
| 4,061,188 | A | | 12/1977 | Beck |
| 4,073,613 | A | | 2/1978 | Desty |
| 4,090,814 | A | | 5/1978 | Teodorescu et al. |
| 4,113,416 | A | | 9/1978 | Kataoka et al. |
| 4,136,735 | A | | 1/1979 | Beck et al. |
| 4,173,995 | A | | 11/1979 | Beck |
| 4,180,130 | A | | 12/1979 | Beck et al. |
| 4,184,417 | A | | 1/1980 | Chancellor |
| 4,184,541 | A | | 1/1980 | Beck et al. |
| 4,192,461 | A | | 3/1980 | Arborg |
| 4,332,529 | A | | 6/1982 | Alperin |
| 4,336,017 | A | | 6/1982 | Desty |
| 4,342,204 | A | | 8/1982 | Melikian et al. |
| 4,448,354 | A | | 5/1984 | Reznick et al. |
| 4,568,243 | A | | 2/1986 | Schubert et al. |
| 4,630,475 | A | | 12/1986 | Mizoguchi |
| 4,643,351 | A | | 2/1987 | Fukamachi et al. |
| 4,703,152 | A | | 10/1987 | Shih-Chin |
| 4,718,870 | A | | 1/1988 | Watts |
| 4,732,539 | A | | 3/1988 | Shin-Chin |
| 4,734,017 | A | | 3/1988 | Levin |
| 4,790,133 | A | | 12/1988 | Stuart |
| 4,826,084 | A | * | 5/1989 | Wallace ..... 239/290 |
| 4,850,804 | A | | 7/1989 | Huang |
| 4,878,620 | A | | 11/1989 | Tarleton |
| 4,893,990 | A | | 1/1990 | Tomohiro et al. |
| 4,978,281 | A | | 12/1990 | Conger |
| 5,061,405 | A | | 10/1991 | Stanek et al. |
| D325,435 | S | | 4/1992 | Coup et al. |
| 5,110,266 | A | | 5/1992 | Toyoshima et al. |
| 5,168,722 | A | | 12/1992 | Brock |
| 5,176,856 | A | | 1/1993 | Takahashi et al. |
| 5,188,508 | A | | 2/1993 | Scott et al. |
| 5,296,769 | A | | 3/1994 | Havens et al. |
| 5,310,313 | A | | 5/1994 | Chen |
| 5,317,815 | A | | 6/1994 | Hwang |
| 5,402,938 | A | | 4/1995 | Sweeney |
| 5,407,324 | A | | 4/1995 | Starnes, Jr. et al. |
| 5,425,902 | A | | 6/1995 | Miller et al. |
| 5,435,489 | A | | 7/1995 | Jenkins et al. |
| 5,518,370 | A | | 5/1996 | Wang et al. |
| 5,609,473 | A | | 3/1997 | Litvin |
| 5,645,769 | A | | 7/1997 | Tamaru et al. |
| 5,649,370 | A | | 7/1997 | Russo |
| 5,671,321 | A | | 9/1997 | Bagnuolo |
| 5,735,683 | A | | 4/1998 | Muschelknautz |
| 5,762,034 | A | | 6/1998 | Foss |
| 5,762,661 | A | | 6/1998 | Kleinberger et al. |
| 5,783,117 | A | | 7/1998 | Byassee et al. |
| 5,794,306 | A | | 8/1998 | Firdaus |
| D398,983 | S | | 9/1998 | Keller et al. |
| 5,841,080 | A | | 11/1998 | Iida et al. |
| 5,843,344 | A | | 12/1998 | Junket et al. |
| 5,862,037 | A | | 1/1999 | Behl |
| 5,868,197 | A | | 2/1999 | Potier |
| 5,881,685 | A | | 3/1999 | Foss et al. |
| D415,271 | S | | 10/1999 | Feer |
| 6,015,274 | A | | 1/2000 | Bias et al. |
| 6,073,881 | A | | 6/2000 | Chen |
| D429,808 | S | | 8/2000 | Krauss et al. |
| 6,123,618 | A | | 9/2000 | Day |
| 6,155,782 | A | | 12/2000 | Hsu |
| D435,899 | S | | 1/2001 | Melwani |
| 6,254,337 | B1 | | 7/2001 | Arnold |
| 6,269,549 | B1 | | 8/2001 | Carlucci et al. |
| 6,278,248 | B1 | | 8/2001 | Hong et al. |
| 6,282,746 | B1 | | 9/2001 | Schleeter |
| 6,293,121 | B1 | | 9/2001 | Labrador |
| 6,321,034 | B2 | | 11/2001 | Jones-Lawlor et al. |
| 6,386,845 | B1 | | 5/2002 | Bedard |
| 6,480,672 | B1 | | 11/2002 | Rosenzweig et al. |
| 6,599,088 | B2 | | 7/2003 | Stagg |
| 6,604,694 | B1 | | 8/2003 | Kordas et al. |
| D485,895 | S | | 1/2004 | Melwani |
| 6,789,787 | B2 | | 9/2004 | Stutts |
| 6,791,056 | B2 | | 9/2004 | VanOtteren et al. |
| 6,830,433 | B2 | | 12/2004 | Birdsell et al. |
| 7,059,826 | B2 | | 6/2006 | Lasko |
| 7,088,913 | B1 | | 8/2006 | Verhoorn et al. |
| 7,147,336 | B1 | | 12/2006 | Chou |
| D539,414 | S | | 3/2007 | Russak et al. |
| 7,192,258 | B2 | | 3/2007 | Kuo et al. |
| 7,198,473 | B2 | | 4/2007 | Stickland et al. |
| 7,412,781 | B2 | | 8/2008 | Mattinger et al. |
| 7,478,993 | B2 | | 1/2009 | Hong et al. |
| 7,540,474 | B1 | | 6/2009 | Huang et al. |
| D598,532 | S | | 8/2009 | Dyson et al. |
| D602,143 | S | | 10/2009 | Gammack et al. |
| D602,144 | S | | 10/2009 | Dyson et al. |
| D605,748 | S | | 12/2009 | Gammack et al. |
| 7,660,110 | B2 | | 2/2010 | Vinson et al. |
| 7,664,377 | B2 | | 2/2010 | Liao |
| D614,280 | S | | 4/2010 | Dyson et al. |

(56) References Cited

U.S. PATENT DOCUMENTS

| | | | | |
|---|---|---|---|---|
| 7,731,050 | B2 | 6/2010 | Parks et al. | |
| 7,775,848 | B1 | 8/2010 | Auerbach | |
| 7,806,388 | B2 | 10/2010 | Junkel et al. | |
| 7,841,045 | B2 | 11/2010 | Shaanan et al. | |
| 8,002,520 | B2 | 8/2011 | Dawson et al. | |
| 8,092,166 | B2 | 1/2012 | Nicolas et al. | |
| 8,113,490 | B2 | 2/2012 | Chen | |
| 8,152,495 | B2 | 4/2012 | Boggess, Jr. et al. | |
| 8,246,317 | B2 | 8/2012 | Gammack | |
| 8,308,445 | B2 | 11/2012 | Gammack et al. | |
| 8,348,629 | B2 | 1/2013 | Fitton et al. | |
| 8,356,804 | B2 | 1/2013 | Fitton et al. | |
| 8,454,322 | B2 | 6/2013 | Gammack et al. | |
| 8,529,226 | B2 | 9/2013 | Li | |
| 8,544,826 | B2 | 10/2013 | Ediger et al. | |
| 8,721,307 | B2 | 5/2014 | Li | |
| 2002/0106547 | A1 | 8/2002 | Sugawara et al. | |
| 2003/0059307 | A1 | 3/2003 | Moreno et al. | |
| 2003/0164367 | A1 | 9/2003 | Bucher et al. | |
| 2003/0171093 | A1 | 9/2003 | Gumucio Del Pozo | |
| 2003/0190183 | A1 | 10/2003 | Hsing | |
| 2004/0022631 | A1 | 2/2004 | Birdsell et al. | |
| 2004/0049842 | A1 | 3/2004 | Prehodka | |
| 2004/0106370 | A1 | 6/2004 | Honda et al. | |
| 2004/0149881 | A1 | 8/2004 | Allen | |
| 2005/0031448 | A1 | 2/2005 | Lasko et al. | |
| 2005/0053465 | A1 | 3/2005 | Roach et al. | |
| 2005/0069407 | A1 | 3/2005 | Winkler et al. | |
| 2005/0128698 | A1 | 6/2005 | Huang | |
| 2005/0163670 | A1 | 7/2005 | Alleyne et al. | |
| 2005/0173997 | A1 | 8/2005 | Schmid et al. | |
| 2005/0281672 | A1 | 12/2005 | Parker et al. | |
| 2006/0172682 | A1 | 8/2006 | Orr et al. | |
| 2006/0199515 | A1 | 9/2006 | Lasko et al. | |
| 2006/0263073 | A1 | 11/2006 | Clarke et al. | |
| 2006/0279927 | A1 | 12/2006 | Strohm | |
| 2007/0035189 | A1 | 2/2007 | Matsumoto | |
| 2007/0041857 | A1 | 2/2007 | Fleig | |
| 2007/0065280 | A1 | 3/2007 | Fok | |
| 2007/0166160 | A1 | 7/2007 | Russak et al. | |
| 2007/0176502 | A1 | 8/2007 | Kasai et al. | |
| 2007/0210186 | A1* | 9/2007 | Fenton | A62C 5/002 239/422 |
| 2007/0224044 | A1 | 9/2007 | Hong et al. | |
| 2007/0269323 | A1 | 11/2007 | Zhou et al. | |
| 2008/0020698 | A1 | 1/2008 | Spaggiari | |
| 2008/0124060 | A1 | 5/2008 | Gao | |
| 2008/0152482 | A1 | 6/2008 | Patel | |
| 2008/0166224 | A1 | 7/2008 | Giffin | |
| 2008/0286130 | A1 | 11/2008 | Purvines | |
| 2008/0314250 | A1 | 12/2008 | Cowie et al. | |
| 2009/0026850 | A1 | 1/2009 | Fu | |
| 2009/0032130 | A1 | 2/2009 | Dumas et al. | |
| 2009/0039805 | A1 | 2/2009 | Tang | |
| 2009/0060710 | A1 | 3/2009 | Gammack et al. | |
| 2009/0060711 | A1 | 3/2009 | Gammack et al. | |
| 2009/0078120 | A1 | 3/2009 | Kummer et al. | |
| 2009/0120925 | A1 | 5/2009 | Lasko | |
| 2009/0191054 | A1 | 7/2009 | Winkler | |
| 2009/0214341 | A1 | 8/2009 | Craig | |
| 2010/0133707 | A1 | 6/2010 | Huang | |
| 2010/0150699 | A1 | 6/2010 | Nicolas et al. | |
| 2010/0162011 | A1 | 6/2010 | Min | |
| 2010/0171465 | A1 | 7/2010 | Seal et al. | |
| 2010/0225012 | A1 | 9/2010 | Fitton et al. | |
| 2010/0226749 | A1 | 9/2010 | Gammack et al. | |
| 2010/0226750 | A1 | 9/2010 | Gammack | |
| 2010/0226751 | A1 | 9/2010 | Gammack et al. | |
| 2010/0226752 | A1 | 9/2010 | Gammack et al. | |
| 2010/0226753 | A1 | 9/2010 | Dyson et al. | |
| 2010/0226754 | A1 | 9/2010 | Hutton et al. | |
| 2010/0226758 | A1 | 9/2010 | Cookson et al. | |
| 2010/0226763 | A1 | 9/2010 | Gammack et al. | |
| 2010/0226764 | A1 | 9/2010 | Gammack et al. | |
| 2010/0226769 | A1 | 9/2010 | Helps | |
| 2010/0226771 | A1 | 9/2010 | Crawford et al. | |
| 2010/0226787 | A1 | 9/2010 | Gammack et al. | |
| 2010/0226797 | A1 | 9/2010 | Fitton et al. | |
| 2010/0226801 | A1 | 9/2010 | Gammack | |
| 2010/0254800 | A1 | 10/2010 | Fitton et al. | |
| 2011/0058935 | A1 | 3/2011 | Gammack et al. | |
| 2011/0110805 | A1 | 5/2011 | Gammack et al. | |
| 2011/0127701 | A1* | 6/2011 | Grant et al. | 266/44 |
| 2011/0164959 | A1 | 7/2011 | Fitton et al. | |
| 2011/0223014 | A1 | 9/2011 | Crawford et al. | |
| 2011/0223015 | A1 | 9/2011 | Gammack et al. | |
| 2012/0031509 | A1 | 2/2012 | Wallace et al. | |
| 2012/0033952 | A1* | 2/2012 | Wallace et al. | 392/367 |
| 2012/0034108 | A1 | 2/2012 | Wallace et al. | |
| 2012/0039705 | A1 | 2/2012 | Gammack | |
| 2012/0045315 | A1 | 2/2012 | Gammack | |
| 2012/0045316 | A1 | 2/2012 | Gammack | |
| 2012/0057959 | A1 | 3/2012 | Hodgson et al. | |
| 2012/0082561 | A1 | 4/2012 | Gammack et al. | |
| 2012/0093629 | A1 | 4/2012 | Fitton et al. | |
| 2012/0093630 | A1 | 4/2012 | Fitton et al. | |
| 2012/0114513 | A1 | 5/2012 | Simmonds et al. | |
| 2012/0230658 | A1 | 9/2012 | Fitton et al. | |
| 2012/0308375 | A1 | 12/2012 | Gammack | |
| 2013/0026664 | A1 | 1/2013 | Staniforth et al. | |
| 2013/0028763 | A1 | 1/2013 | Staniforth et al. | |
| 2013/0028766 | A1 | 1/2013 | Staniforth et al. | |
| 2013/0129490 | A1 | 5/2013 | Dos Reis et al. | |
| 2013/0161842 | A1 | 6/2013 | Fitton et al. | |
| 2013/0199372 | A1 | 8/2013 | Nock et al. | |
| 2013/0272858 | A1 | 10/2013 | Stickney et al. | |
| 2013/0280051 | A1 | 10/2013 | Nicolas et al. | |
| 2013/0280061 | A1 | 10/2013 | Stickney | |
| 2013/0280096 | A1 | 10/2013 | Gammack et al. | |
| 2014/0079566 | A1 | 3/2014 | Gammack et al. | |
| 2014/0084492 | A1 | 3/2014 | Staniforth et al. | |
| 2014/0210114 | A1 | 7/2014 | Staniforth et al. | |
| 2014/0255173 | A1 | 9/2014 | Poulton et al. | |
| 2014/0255217 | A1 | 9/2014 | Li | |

FOREIGN PATENT DOCUMENTS

| | | |
|---|---|---|
| CA | 2155482 | 9/1996 |
| CH | 346643 | 5/1960 |
| CN | 2085866 | 10/1991 |
| CN | 2111392 | 7/1992 |
| CN | 1437300 | 8/2003 |
| CN | 2650005 | 10/2004 |
| CN | 2713643 | 7/2005 |
| CN | 1680727 | 10/2005 |
| CN | 2833197 | 11/2006 |
| CN | 201011346 | 1/2008 |
| CN | 201180678 | 1/2009 |
| CN | 201221477 | 4/2009 |
| CN | 101424279 | 5/2009 |
| CN | 101451754 | 6/2009 |
| CN | 201281416 | 7/2009 |
| CN | 201349269 | 11/2009 |
| CN | 101684828 | 3/2010 |
| CN | 201486901 | 5/2010 |
| CN | 101749288 | 6/2010 |
| CN | 201502549 | 6/2010 |
| CN | 201507461 | 6/2010 |
| CN | 101825096 | 9/2010 |
| CN | 101825101 | 9/2010 |
| CN | 101825102 | 9/2010 |
| CN | 101825103 A | 9/2010 |
| CN | 101825104 | 9/2010 |
| CN | 201568337 | 9/2010 |
| CN | 101858355 | 10/2010 |
| CN | 101936310 | 1/2011 |
| CN | 201696365 U | 1/2011 |
| CN | 201696366 | 1/2011 |
| CN | 201739199 U | 2/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |

(56) References Cited

FOREIGN PATENT DOCUMENTS

| | | |
|---|---|---|
| CN | 201771875 | 3/2011 |
| CN | 201779080 | 3/2011 |
| CN | 201786777 | 4/2011 |
| CN | 201786778 | 4/2011 |
| CN | 201802648 | 4/2011 |
| CN | 102095236 | 6/2011 |
| CN | 201858204 | 6/2011 |
| CN | 201874898 | 6/2011 |
| CN | 201874901 U | 6/2011 |
| CN | 201917047 | 8/2011 |
| CN | 102251973 A | 11/2011 |
| CN | 102287357 | 12/2011 |
| CN | 102367813 | 3/2012 |
| CN | 202267207 | 6/2012 |
| CN | 202431623 | 9/2012 |
| DE | 1 291 090 | 3/1969 |
| DE | 24 51 557 | 5/1976 |
| DE | 27 48 724 | 5/1978 |
| DE | 3644567 | 7/1988 |
| DE | 195 10 397 | 9/1996 |
| DE | 197 12 228 | 10/1998 |
| DE | 100 00 400 | 3/2001 |
| DE | 10041805 | 6/2002 |
| DE | 10 2009 007 | 8/2010 |
| EP | 0 044 494 | 1/1982 |
| EP | 0186581 | 7/1986 |
| EP | 0 784 947 | 7/1997 |
| EP | 1 094 224 | 4/2001 |
| EP | 1 138 954 | 10/2001 |
| EP | 1357296 B1 | 10/2003 |
| EP | 1 779 745 | 5/2007 |
| EP | 1 939 456 | 7/2008 |
| EP | 1 980 432 | 10/2008 |
| EP | 2 000 675 | 12/2008 |
| EP | 2191142 | 6/2010 |
| EP | 2 578 889 | 4/2013 |
| FR | 1033034 | 7/1953 |
| FR | 1119439 | 6/1956 |
| FR | 1387334 | 1/1965 |
| FR | 2 375 471 | 7/1978 |
| FR | 2 534 983 | 4/1984 |
| FR | 2 640 857 | 6/1990 |
| FR | 2 658 593 | 8/1991 |
| FR | 2794195 | 12/2000 |
| FR | 2 874 409 | 2/2006 |
| FR | 2 906 980 | 4/2008 |
| FR | 2928706 | 9/2009 |
| GB | 22235 | 6/1914 |
| GB | 383498 | 11/1932 |
| GB | 593828 | 10/1947 |
| GB | 601222 | 4/1948 |
| GB | 633273 | 12/1949 |
| GB | 641622 | 8/1950 |
| GB | 661747 | 11/1951 |
| GB | 863 124 | 3/1961 |
| GB | 1067956 | 5/1967 |
| GB | 1 262 131 | 2/1972 |
| GB | 1 265 341 | 3/1972 |
| GB | 1 278 606 | 6/1972 |
| GB | 1 304 560 | 1/1973 |
| GB | 1 403 188 | 8/1975 |
| GB | 1 434 226 | 5/1976 |
| GB | 1 501 473 | 2/1978 |
| GB | 2 094 400 | 9/1982 |
| GB | 2 107 787 | 5/1983 |
| GB | 2 111 125 | 6/1983 |
| GB | 2 178 256 | 2/1987 |
| GB | 2 185 531 | 7/1987 |
| GB | 2 185 533 | 7/1987 |
| GB | 2 218 196 | 11/1989 |
| GB | 2 236 804 | 4/1991 |
| GB | 2 240 268 | 7/1991 |
| GB | 2 242 935 | 10/1991 |
| GB | 2 285 504 | 7/1995 |
| GB | 2 289 087 | 11/1995 |
| GB | 2383277 | 6/2003 |
| GB | 2 428 569 | 2/2007 |
| GB | 2 452 593 | 3/2009 |
| GB | 2452490 | 3/2009 |
| GB | 2463698 | 3/2010 |
| GB | 2464736 | 4/2010 |
| GB | 2466058 | 6/2010 |
| GB | 2468312 | 9/2010 |
| GB | 2468313 | 9/2010 |
| GB | 2468315 | 9/2010 |
| GB | 2468317 A | 9/2010 |
| GB | 2468319 | 9/2010 |
| GB | 2468320 | 9/2010 |
| GB | 2468323 | 9/2010 |
| GB | 2468328 | 9/2010 |
| GB | 2468331 | 9/2010 |
| GB | 2468369 | 9/2010 |
| GB | 2468498 | 9/2010 |
| GB | 2473037 | 3/2011 |
| GB | 2479760 | 10/2011 |
| GB | 2482547 | 2/2012 |
| GB | 2484671 | 4/2012 |
| GB | 2484695 A | 4/2012 |
| GB | 2484761 | 4/2012 |
| GB | 2493231 A | 1/2013 |
| GB | 2493505 A | 2/2013 |
| GB | 2493507 A | 2/2013 |
| GB | 2500011 | 9/2013 |
| JP | 31-13055 | 8/1956 |
| JP | 35-4369 | 3/1960 |
| JP | 39-7297 | 3/1964 |
| JP | 46-7230 | 12/1971 |
| JP | 49-150403 | 12/1974 |
| JP | 51-7258 | 1/1976 |
| JP | 53-60100 | 5/1978 |
| JP | 56-167897 | 12/1981 |
| JP | 57-71000 | 5/1982 |
| JP | 57-157097 | 9/1982 |
| JP | 61-31830 | 2/1986 |
| JP | 61-116093 | 6/1986 |
| JP | 61-280787 | 12/1986 |
| JP | 62-223494 | 10/1987 |
| JP | 63-36794 | 3/1988 |
| JP | 63-179198 | 7/1988 |
| JP | 63-306340 | 12/1988 |
| JP | 64-21300 | 2/1989 |
| JP | 64-58955 | 3/1989 |
| JP | 64-83884 | 3/1989 |
| JP | 1-138399 | 5/1989 |
| JP | 1-224598 | 9/1989 |
| JP | 2-146294 | 6/1990 |
| JP | 2-218890 | 8/1990 |
| JP | 2-248690 | 10/1990 |
| JP | 3-52515 | 5/1991 |
| JP | 3-267598 | 11/1991 |
| JP | 3-286775 | 12/1991 |
| JP | 4-43895 | 2/1992 |
| JP | 4-366330 | 12/1992 |
| JP | 5-157093 | 6/1993 |
| JP | 5-164089 | 6/1993 |
| JP | 5-263786 | 10/1993 |
| JP | 6-74190 | 3/1994 |
| JP | 6-86898 | 3/1994 |
| JP | 6-147188 | 5/1994 |
| JP | 6-257591 | 9/1994 |
| JP | 6-280800 | 10/1994 |
| JP | 6-336113 | 12/1994 |
| JP | 7-190443 | 7/1995 |
| JP | 8-21400 | 1/1996 |
| JP | 8-72525 | 3/1996 |
| JP | 9-100800 | 4/1997 |
| JP | 9-178083 | 7/1997 |
| JP | 9-287600 | 11/1997 |
| JP | 11-502586 | 3/1999 |
| JP | 11-227866 | 8/1999 |
| JP | 2000-116179 | 4/2000 |
| JP | 2000-201723 | 7/2000 |
| JP | 2001-17358 | 1/2001 |
| JP | 2002-21797 | 1/2002 |

(56) References Cited

FOREIGN PATENT DOCUMENTS

| | | | | |
|---|---|---|---|---|
| JP | 2002-138829 | | 5/2002 | |
| JP | 2002-213388 | | 7/2002 | |
| JP | 2003-329273 | | 11/2003 | |
| JP | 2004-8275 | | 1/2004 | |
| JP | 2004-208935 | | 7/2004 | |
| JP | 2004-216221 | | 8/2004 | |
| JP | 2005-201507 | | 7/2005 | |
| JP | 2005-307985 | | 11/2005 | |
| JP | 2006-89096 | | 4/2006 | |
| JP | 3127331 | | 11/2006 | |
| JP | 2007-138763 | | 6/2007 | |
| JP | 2007-138789 | | 6/2007 | |
| JP | 2008-39316 | | 2/2008 | |
| JP | 2008-100204 | | 5/2008 | |
| JP | 3146538 | | 10/2008 | |
| JP | 2008-294243 | | 12/2008 | |
| JP | 2009-44568 | | 2/2009 | |
| JP | 2009-62986 | | 3/2009 | |
| JP | 2010-131259 | | 6/2010 | |
| JP | 2010-203764 | | 9/2010 | |
| JP | WO 2011129073 | A1 * | 10/2011 | ..... F04D 17/16 |
| JP | 2012-31806 | | 2/2012 | |
| KR | 1999-002660 | | 1/1999 | |
| KR | 10-2005-0102317 | | 10/2005 | |
| KR | 2007-0007997 | | 1/2007 | |
| KR | 20-0448319 | | 3/2010 | |
| KR | 10-2010-0055611 | | 5/2010 | |
| KR | 10-0985378 | | 9/2010 | |
| TW | 517825 | | 1/2003 | |
| TW | 589932 | | 6/2004 | |
| TW | M394383 | | 12/2010 | |
| TW | M399207 | | 3/2011 | |
| TW | M407299 | | 7/2011 | |
| WO | WO-90/13478 | | 11/1990 | |
| WO | WO-95/06822 | | 3/1995 | |
| WO | WO-02/073096 | | 9/2002 | |
| WO | WO-03/058795 | | 7/2003 | |
| WO | WO-03/069931 | | 8/2003 | |
| WO | WO-2005/050026 | | 6/2005 | |
| WO | WO 2005/057091 | | 6/2005 | |
| WO | WO-2006/008021 | | 1/2006 | |
| WO | WO-2006/012526 | | 2/2006 | |
| WO | WO-2007/024955 | | 3/2007 | |
| WO | WO-2007/048205 | | 5/2007 | |
| WO | WO-2008/014641 | | 2/2008 | |
| WO | WO-2008/024569 | | 2/2008 | |
| WO | WO-2008/139491 | | 11/2008 | |
| WO | WO-2009/030879 | | 3/2009 | |
| WO | WO-2009/030881 | | 3/2009 | |
| WO | WO-2010/100449 | A1 | 9/2010 | |
| WO | WO-2010/100451 | | 9/2010 | |
| WO | WO-2010/100452 | | 9/2010 | |
| WO | WO-2010/100453 | | 9/2010 | |
| WO | WO-2010/100462 | | 9/2010 | |
| WO | WO-2011/050041 | | 4/2011 | |
| WO | WO-2012/006882 | A1 | 1/2012 | |
| WO | WO-2012/033517 | A1 | 3/2012 | |
| WO | WO-2012/052737 | | 4/2012 | |
| WO | WO-2013/014419 | A2 | 1/2013 | |

OTHER PUBLICATIONS

Li et al., U.S. Office Action dated Oct. 25, 2013, directed to U.S. Appl. No. 13/686,480; 17 pages.
Gammack et al., U.S. Office Action dated Apr. 24, 2014, directed to U.S Appl. No. 12/716,740; 16 pages.
Gammack et al., Office Action dated Jun. 12, 2013, directed towards U.S. Appl. No. 12/945,558; 20 pages.
Gammack et al., Office Action dated May 29, 2013, directed towards U.S. Appl. No. 13/588,666; 11 pages.
Wallace et al., Office Action dated Jun. 7, 2013, directed towards U.S. Appl. No. 13/192,223; 30 pages.
Fitton et al., U.S. Office Action dated Jun. 13, 2014, directed to U.S. Appl. No. 13/274,998; 11 pages.
Fitton et al., U.S. Office Action dated Jun. 13, 2014, directed to U.S. Appl. No. 13/275,034; 10 pages.
Gammack, P. et al., U.S. Office Action dated Feb. 10, 2014, directed to U.S. Appl. No. 12/716,515; 21 pages.
Gammack et al., U.S. Office Action dated Feb. 28, 2013, directed to U.S. Appl. No. 12/945,558; 16 pages.
Gammack et al., U.S. Office Action dated Feb. 14, 2013, directed to U.S. Appl. No. 12/716,515; 21 pages.
Gammack et al., U.S. Office Action dated Mar. 14, 2013, directed to U.S. Appl. No. 12/716,740; 15 pages.
Gammack et al., U.S. Office Action dated Sep. 3, 2014, directed to U.S. Appl. No. 13/861,891; 7 pages.
Staniforth et al., U.S. Office Action dated Sep. 18, 2014, directed to U.S. Appl. No. 13/559,142; 18 pages.
International Search Report and Written Opinion dated Sep. 24, 2013, directed to International Application No. PCT/GB2012/052743; 13 pages.
Gammack et al., U.S. Office Action dated Sep. 6, 2013, directed to U.S. Appl. No. 12/716,740; 15 pages.
Gammack et al., Office Action dated Sep. 27, 2013, directed to U.S. Appl. No. 13/588,666; 10 pages.
Wallace et al., Office Action dated Oct. 23, 2013, directed to U.S. Appl. No. 13/192,223; 18 pages.
Search Report dated Mar. 12, 2012, directed to GB Application No. 1120268.6; 1 page.
Gammack, P. et al., U.S. Office Action dated Dec. 9, 2010, directed to U.S. Appl. No. 12/203,698; 10 pages.
Gammack, P. et al., U.S. Office Action dated Jun. 21,2011, directed to U.S. Appl. No. 12/203,698; 11 pages.
Gammack et al., Office Action dated Sep. 17, 2012, directed to U.S. Appl. No. 13/114,707; 12 pages.
Gammack, P. et al., U.S. Office Action dated Dec. 10, 2010, directed to U.S. Appl. No. 12/230,613; 12 pages.
Gammack, P. et al., U.S. Office Action dated May 13, 2011, directed to U.S. Appl. No. 12/230,613; 13 pages.
Gammack, P. et al., U.S. Office Action dated Sep. 7, 2011, directed to U.S. Appl. No. 12/230,613; 15 pages.
Gammack, P. et al., U.S. Office Action dated Jun. 8, 2012, directed to U.S. Appl. No. 12/230,613; 15 pages.
Gammack et al., U.S. Office Action dated Aug. 20, 2012, directed to U.S. Appl. No. 12/945,558; 15 pages.
Fitton et al., U.S. Office Action dated Nov. 30, 2010 directed to U.S. Appl. No. 12/560,232; 9 pages.
Nicolas, F. et al., U.S. Office Action dated Mar. 7, 2011, directed to U.S. Appl. No. 12/622,844; 10 pages.
Nicolas, F. et al., U.S. Office Action dated Sep. 8, 2011, directed to U.S. Appl. No. 12/622,844; 11 pages.
Fitton, et al., U.S. Office Action dated Mar. 8, 2011, directed to U.S. Appl. No. 12/716,780; 12 pages.
Fitton, et al., U.S. Office Action dated Sep. 6, 2011, directed to U.S. Appl. No. 12/716,780; 16 pages.
Gammack, P. et al., U.S. Office Action dated Dec. 9, 2010, directed to U.S. Appl. No. 12/716,781; 17 pages.
Gammack, P. et al., U.S. Final Office Action dated Jun. 24, 2011, directed to U.S. Appl. No. 12/716,781; 19 pages.
Gammack, P. et al., U.S. Office Action dated Apr. 12, 2011, directed to U.S. Appl. No. 12/716,749; 8 pages.
Gammack, P. et al., U.S. Office Action dated Sep. 1, 2011, directed to U.S. Appl. No. 12/716,749; 9 pages.
Gammack, P. et al., U.S. Office Action dated Jun. 25, 2012, directed to U.S. Appl. No. 12/716,749; 11 pages.
Fitton et al., U.S. Office Action dated Mar. 30, 2012, directed to U.S. Appl. No. 12/716,707; 7 pages.
Gammack, P. et al., U.S. Office Action dated May 24, 2011, directed to U.S. Appl. No. 12/716,613; 9 pages.
Gammack, P. et al. U.S. Office Action dated Oct. 18, 2012, directed to U.S. Appl. No. 12/917,247; 11 pages.
Reba, I. (1966). "Applications of the Coanda Effect," *Scientific American* 214:84-92.
Third Party Submission Under 37 CFR 1.99 filed Jun. 2, 2011, directed towards U.S. Appl. No. 12/203,698; 3 pages.
Gammack, P. et al., Office Action dated Aug. 19, 2013, directed to U.S. Appl. No. 12/716,515; 20 pages.

(56) References Cited

OTHER PUBLICATIONS

Helps, D. F. et al., U.S. Office Action dated Feb. 15, 2013, directed to U.S. Appl. No. 12/716,694; 12 pages.
Fitton et al., U.S. Office Action dated Dec. 31, 2013, directed to U.S. Appl. No. 13/718,693; 8 pages.

* cited by examiner

FAN ASSEMBLY

REFERENCE TO RELATED APPLICATIONS

This application claims the priority of United Kingdom Application No. 1120268.6, filed Nov. 24, 2011, the entire contents of which are incorporated herein by reference.

FIELD OF THE INVENTION

The present invention relates to a nozzle for a fan assembly, and a fan assembly comprising such a nozzle.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. The blades are generally located within a cage which allows an air flow to pass through the housing while preventing users from coming into contact with the rotating blades during use of the fan.

U.S. Pat. No. 2,488,467 describes a fan which does not use caged blades to project air from the fan assembly. Instead, the fan assembly comprises a base which houses a motor-driven impeller for drawing an air flow into the base, and a series of concentric, annular nozzles connected to the base and each comprising an annular outlet located at the front of the nozzle for emitting the air flow from the fan. Each nozzle extends about a bore axis to define a bore about which the nozzle extends.

Each nozzle is in the shape of an airfoil. An airfoil may be considered to have a leading edge located at the rear of the nozzle, a trailing edge located at the front of the nozzle, and a chord line extending between the leading and trailing edges. In U.S. Pat. No. 2,488,467 the chord line of each nozzle is parallel to the bore axis of the nozzles. The air outlet is located on the chord line, and is arranged to emit the air flow in a direction extending away from the nozzle and along the chord line.

Another fan assembly which does not use caged blades to project air from the fan assembly is described in WO 2010/100451. This fan assembly comprises a cylindrical base which also houses a motor-driven impeller for drawing a primary air flow into the base, and a single annular nozzle connected to the base and comprising an annular mouth through which the primary air flow is emitted from the fan. The nozzle defines an opening through which air in the local environment of the fan assembly is drawn by the primary air flow emitted from the mouth, amplifying the primary air flow. The nozzle includes a Coanda surface over which the mouth is arranged to direct the primary air flow. The Coanda surface extends symmetrically about the central axis of the opening so that the air flow generated by the fan assembly is in the form of an annular jet having a cylindrical or frusto-conical profile.

The user is able to change the direction in which the air flow is emitted from the nozzle in one of two ways. The base includes an oscillation mechanism which can be actuated to cause the nozzle and part of the base to oscillate about a vertical axis passing through the centre of the base so that that air flow generated by the fan assembly is swept about an arc of around 180°. The base also includes a tilting mechanism to allow the nozzle and an upper part of the base to be tilted relative to a lower part of the base by an angle of up to 10° to the horizontal.

SUMMARY OF THE INVENTION

The present invention provides a nozzle for a fan assembly, the nozzle comprising an air inlet, an air outlet, an interior passage for conveying air from the air inlet to the air outlet, an annular inner wall, an outer wall extending about the inner wall, the interior passage being located between the inner wall and the outer wall, the inner wall at least partially defining a bore through which air from outside the nozzle is drawn by air emitted from the air outlet, a flow control port located downstream from the air outlet, a flow control chamber for conveying air to the flow control port, and control means for selectively inhibiting a flow of air through the flow control port.

Through selectively inhibiting a flow of air through the flow control port, the profile of the air flow emitted from the air outlet can be changed. The inhibition of the flow of air through the flow control port can have the effect of changing a pressure gradient across the air flow emitted from the nozzle. The change in the pressure gradient can result in the generation of a force that acts on the emitted air flow. The action of this force can result in the air flow moving in a desired direction.

The nozzle preferably comprises a guide surface located downstream from the air outlet. The guide surface may be located adjacent to the air outlet. The air outlet may be arranged to direct an air flow over the guide surface. The flow control port may be located between the air outlet and the guide surface. For example, the flow control port may be located adjacent to the air outlet.

The flow control port may be arranged to direct air over the guide surface. The flow control port may be located between the air outlet and the guide surface. Alternatively, the flow control port may be located within, downstream of at least part of the guide surface.

The nozzle may comprise a single guide surface, but in one embodiment the nozzle comprises two guide surfaces, with the air outlet being arranged to emit the air flow between the two guide surfaces. The flow control chamber may comprise a first flow control port located adjacent the first guide surface, and a second flow control port located adjacent the second guide surface. Alternatively, the nozzle may comprise a first flow control chamber and a second flow control chamber, with each flow control chamber having a respective flow control port located adjacent a respective guide surface.

When air is emitted from each of the flow control ports to combine with the air flow emitted from the air outlet, the air flow emitted from the nozzle will tend to become attached to one of the two guide surfaces. The guide surface to which the air flow becomes attached can depend on one or more of a number of design parameters, such as the flow rate of the air through the flow control ports, the speed of the air emitted from the flow control ports, the shape of the air outlet, the orientation of the air outlet relative to the guide surfaces and the shape of the guide surfaces.

When the flow of air through one of the flow control ports is inhibited, for example by occluding one of the flow control ports or by inhibiting the flow of air through the flow control chamber connected to that flow control port, the pressure gradient across the air flow emitted from the nozzle is changed. For example, if substantially no air is emitted from a first flow control port located adjacent to a first guide surface, a relatively low pressure may be created adjacent to that first guide surface. The pressure differential thus created across the air flow generates a force which urges the air flow towards the first guide surface. Of course, depending on the aforementioned design parameters the air flow may already have been attached to that surface, in which case the air flow remains attached to that guide surface when the flow of air through the first control port is inhibited. When the flow of air through the flow control ports is subsequently switched so that substantially no air is emitted from the second flow control port, but air is emitted from the first flow control port, the pressure differential across the air flow is reversed. This in turn generates a force which urges the air flow towards the second guide surface, to which the air flow may become attached. The air flow preferably becomes detached from the first guide surface.

On the other hand, depending on the flow rate and/or the speed at which air is emitted from the "open" flow control port the air flow emitted from that flow control port may become attached to the guide surface located adjacent to that flow control port. In this case, the air flow emitted from the air outlet may become entrained within the air flow emitted from the flow control port.

In either case, the direction in which air is emitted from the nozzle depends on the shape of the guide surface to which the air flow is attached. For example, the guide surface may taper outwardly relative to an axis of the bore so that the air flow emitted from the nozzle has an outwardly flared profile. Alternatively, the guide surface may taper inwardly relative to the axis of the bore so that the air flow emitted from the nozzle has an inwardly tapering profile. Where the nozzle includes two such guide surfaces, one guide surface may taper towards the bore and the other guide surface may taper away from the bore. The guide surface may be frusto-conical in shape, or it may be curved. In one embodiment, the guide surface is convex in shape. The guide surface may be faceted, with each facet being either straight or curved.

As mentioned above, through selective inhibition of an air flow from a flow control port the air flow emitted from the air outlet may become attached to, or detached from, a guide surface. The, or each, flow control port may be located between the air outlet and a guide surface, and so may be arranged to emit air over a guide surface.

In the event that the inhibition of an air flow from a flow control port results in the air flow becoming detached from a first guide surface, but not attached to a second guide surface, the direction in which air is emitted from the nozzle can depend on parameters such as the inclination of the air outlet relative to the axis of the bore of the nozzle. For example, the air outlet may be arranged to emit air in a direction which extends towards the axis of the bore.

The air outlet is preferably in the form of a slot. The interior passage preferably surrounds the bore of the nozzle. The air outlet preferably extends at least partially about the bore. For example, the nozzle may comprise a single air outlet which extends at least partially about the bore. For example, the air outlet also may surround the bore. The bore may have a circular cross-section in a plane which is perpendicular to the bore axis, and so the air outlet may be circular in shape. Alternatively, the nozzle may comprise a plurality of air outlets which are spaced about the bore.

The nozzle may be shaped to define a bore which has a non-circular cross-section in a plane which is perpendicular to the bore axis. For example, this cross-section may be elliptical or rectangular. The nozzle may have two relatively long straight sections, an upper curved section and a lower curved section, with each curved section joining respective ends of the straight sections. Again, the nozzle may comprise a single air outlet which extends at least partially about the bore. For example, each of the straight sections and the upper curved section of the nozzle may comprise a respective part of this air outlet. Alternatively, the nozzle may comprise two air outlets each for emitting a respective part of an air flow. Each straight section of the nozzle may comprise a respective one of these two air outlets.

The guide surface preferably extends at least partially about the bore, and more preferably surrounds the bore. Where the nozzle comprises two guide surfaces, a first guide surface preferably extends at least partially about, and more preferably surrounds, a second guide surface, so that the second guide surface lies between the bore and the first guide surface.

The nozzle may be conveniently formed with an annular front casing section which defines the air outlet(s), and which has a first annular surface defining the first guide surface and a second annular surface connected to and extending about the first annular curved surface, and defining the second guide surface. The two annular surfaces of the casing section may be connected by a plurality of spokes or webs which extend between the annular surfaces, across the air outlet(s). As a result, when each part of the air flow is attached to the first guide surface, air may be emitted from the nozzle with a profile which tapers inwardly towards the axis of the bore, whereas when each part of the air flow is attached to the second guide surface air may be emitted from the nozzle with a profile which tapers outwardly away from the axis of the bore.

The air emitted from the nozzle, hereafter referred to as a primary air flow, entrains air surrounding the nozzle, which thus acts as an air amplifier to supply both the primary air flow and the entrained air to the user. The entrained air will be referred to here as a secondary air flow. The secondary air flow is drawn from the room space, region or external environment surrounding the nozzle. The primary air flow combines with the entrained secondary air flow to form a combined, or total, air flow projected forward from the front of the nozzle.

The variation of the direction in which the primary air flow is emitted from the nozzle can vary the degree of the entrainment of the secondary air flow by the primary air flow, and thus vary the flow rate of the combined air flow generated by the fan assembly.

Without wishing to be bound by any theory, we consider that the rate of entrainment of the secondary air flow by the primary air flow may be related to the magnitude of the surface area of the outer profile of the primary air flow emitted from the nozzle. For a given flow rate of air entering the nozzle, when the primary air flow is outwardly tapering, or flared, the surface area of the outer profile is relatively high, promoting mixing of the primary air flow and the air surrounding the nozzle and thus increasing the flow rate of the combined air flow, whereas when the primary air flow is inwardly tapering, the surface area of the outer profile is relatively low, decreasing the entrainment of the secondary air flow by the primary air flow and so decreasing the flow rate of the combined air flow. The inducement of a flow of air though the bore of the nozzle may also be impaired.

Increasing the flow rate, as measured on a plane perpendicular to the bore axis and offset downstream from the plane of the air outlet, of the combined air flow generated by the nozzle—by changing the direction in which the air flow is emitted from the nozzle—has the effect of decreasing the maximum velocity of the combined air flow on this plane.

This can make the nozzle suitable for generating a relatively diffuse flow of air through a room or an office for cooling a number of users in the proximity of the nozzle. On the other hand, decreasing the flow rate of the combined air flow generated by the nozzle has the effect of increasing the maximum velocity of the combined air flow. This can make the nozzle suitable for generating a flow of air for cooling rapidly a user located in front of the nozzle. The profile of the air flow generated by the nozzle can be rapidly switched between these two different profiles through selectively enabling or inhibiting the passage of an air flow through the flow control chamber.

The geometry of the air outlet(s) and the guide surface(s) may, at least in part, control the two different profiles for the air flow generated by the nozzle. For example, when viewed in a cross-section along a plane passing through the bore axis and located generally midway between the upper and lower ends of the nozzle, the curvature of the first guide surface may be different from the curvature of the second guide surface. For example, in this cross-section the first guide surface may have a higher curvature than the second guide surface.

The air outlet(s) may be disposed so that, for each air outlet, one of the guide surfaces is located closer to that air outlet than the other guide surface. Alternatively, or additionally, the air outlet(s) may be disposed so that one of the guide surfaces is located closer than the other to an imaginary curved surface extending about, and parallel to, the bore axis and which passes centrally through the air outlet(s) so as generally to describe the profile of the air flow emitted from the air outlet(s).

The control means preferably has a first state which inhibits a flow of air through a flow control port, and a second state which allows the flow of air through the flow control port. The control means may be in the form of a valve comprising a valve body for occluding an air inlet of the flow control chamber, and an actuator for moving the valve body relative to the inlet. Alternatively, the valve body may be arranged to occlude the flow control port. The valve may be a manually operable valve which is pushed, pulled or otherwise moved by a user between these two states. In one embodiment, the valve is a solenoid valve which can be actuated remotely by a user, for example using a remote control device, or by operating a button or other switch located on the fan assembly.

The flow control chamber may have an air inlet located on an external surface of the nozzle. In this case, all of the air flow received by the interior passage may be emitted from the air outlet(s). However, the flow control chamber is preferably arranged to receive a flow control air flow from the interior passage. In this case, a first portion of the air flow received by the interior passage may be selectively allowed to enter the flow control chamber to form the flow control air flow, with the remainder of the air flow being emitted from the interior passage through the air outlet(s) to recombine with the flow control air flow downstream from the air outlet(s).

The interior passage may be separated from the flow control chamber by an internal wall of the nozzle. This wall preferably includes the air inlet of the flow control chamber. The air inlet of the flow control chamber is preferably located towards the base of the nozzle through which the air flow enters the nozzle.

The flow control chamber may extend through the nozzle adjacent to the interior passage. Thus, the flow control chamber may extend at least partially about the bore of the nozzle, and may surround the bore.

As mentioned above, the nozzle may comprise a second flow control port located adjacent to the air outlet and a second flow control chamber for conveying air to the second flow control port to deflect an air flow emitted from the air outlet. This second flow control port is preferably located between the air outlet and the second guide surface.

The control means may be arranged to selectively inhibit the flow of air through the second flow control port. The control means may have a first state which inhibits the flow of air through the first flow control port, and a second state which inhibits the flow of air through the second flow control port. For example, the state of the control means may be controlled by adjusting the position of a single valve body. Alternatively, the control means may comprise a first valve body for occluding an air inlet of a first flow control chamber, a second valve body for occluding an air inlet of a second flow control chamber, and an actuator for moving the valve bodies relative to the air inlets. Rather than occlude air inlets of respective flow control chambers, the control means may be arranged to occlude a selected one of the first and second flow control ports.

As with the first flow control chamber, the second flow control chamber may have an air inlet located on an external surface of the nozzle. However, the nozzle preferably comprises means, such as a plurality of internal walls, for dividing the interior volume of the nozzle into the interior passage and the two flow control chambers.

The air inlet of the second flow control chamber is preferably located towards the base of the nozzle. The second flow control chamber may also extend through the nozzle adjacent to the interior passage. Thus, the second flow control chamber may extend at least partially about the bore of the nozzle, and may surround the bore. The air outlet(s) may be located between the flow control chambers.

The interior passage may comprise means for heating at least part of the air flow received by the nozzle.

In a second aspect, the present invention provides a fan assembly comprising an impeller, a motor for rotating the impeller to generate an air flow, a nozzle as aforementioned for receiving the air flow, and a motor controller for controlling the motor. The motor controller may be arranged to adjust automatically the speed of the motor when the control means is operated by a user. For example, the motor controller may be arranged to reduce the speed of the motor when the control means is operated to focus the air flow generated by the nozzle towards the bore axis.

Features described above in connection with the first aspect of the invention are equally applicable to the second aspect of the invention, and vice versa.

BRIEF DESCRIPTION OF THE INVENTION

An embodiment of the present invention will now be described, by way of example only, with reference to the accompanying drawings, in which.

DETAILED DESCRIPTION OF THE INVENTION

Figure 1:
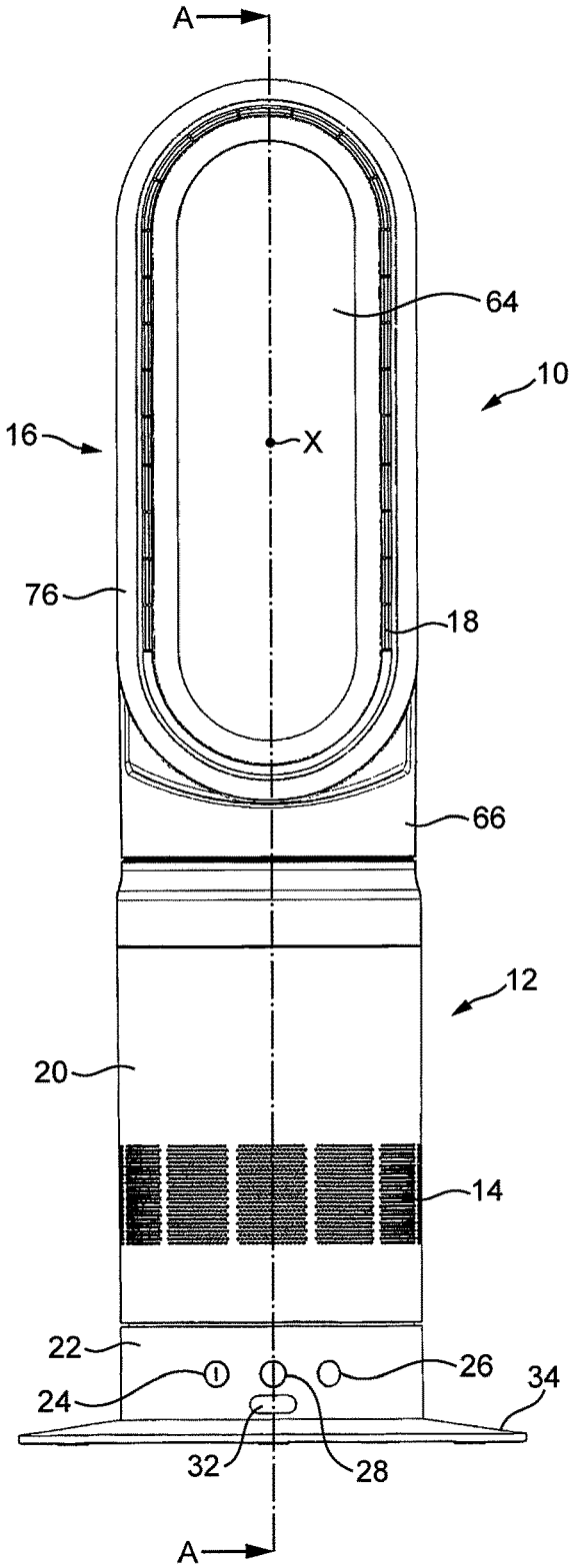
FIG. 1 is a front view of a fan assembly.

FIG. 1 is an external view of a fan assembly 10. The fan assembly 10 comprises a body 12 comprising an air inlet 14 through which an air flow enters the fan assembly 10, and an annular nozzle 16 mounted on the body 12. The nozzle 16 comprises an air outlet 18 for emitting the air flow from the fan assembly 10.

The body 12 comprises a substantially cylindrical main body section 20 mounted on a substantially cylindrical lower body section 22. The main body section 20 and the lower body section 22 preferably have substantially the same external diameter so that the external surface of the upper body section 20 is substantially flush with the external surface of the lower body section 22. The main body section 20 comprises the air inlet 14 through which air enters the fan assembly 10. In this embodiment the air inlet 14 comprises an array of apertures formed in the main body section 20. Alternatively, the air inlet 14 may comprise one or more grilles or meshes mounted within windows formed in the main body section 20. The main body section 20 is open at the upper end (as illustrated) thereof to provide an air outlet 23 (shown in FIG. 2) through which an air flow is exhausted from the body 12. The air outlet 23 may be provided in an optional upper body section located between the nozzle 16 and the main body section 20.

The lower body section 22 comprises a user interface of the fan assembly 10. The user interface comprises a plurality of user-operable buttons 24, 26 and a dial 28 for enabling a user to control various functions of the fan assembly 10, and user interface control circuit 30 connected to the buttons 24, 26 and the dial 28. The lower body section 22 also includes a window 32 through which signals from a remote control (not shown) enter the fan assembly 10. The lower body section 22 is mounted on a base plate 34 for engaging a surface on which the fan assembly 10 is located.

Figure 2:
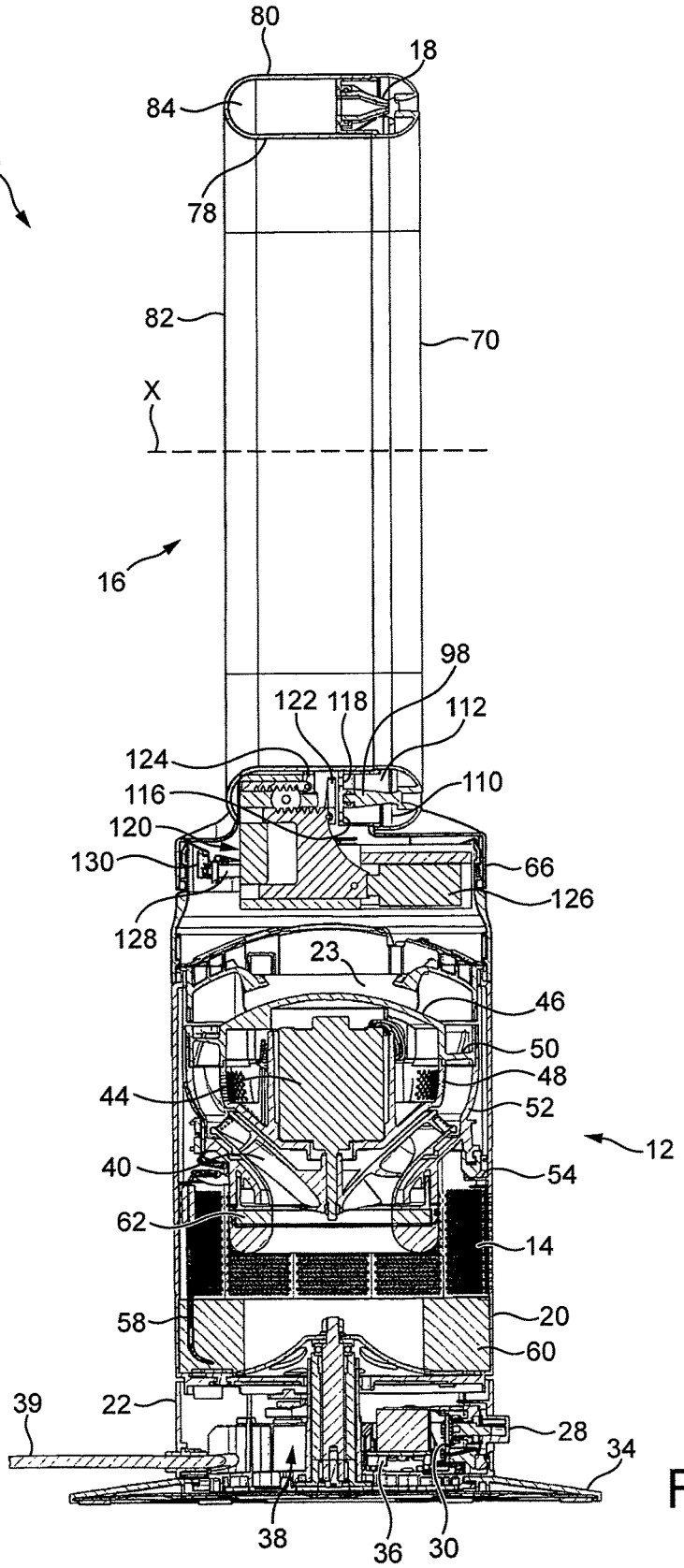
FIG. 2 is a vertical cross-sectional view of the fan assembly, taken along line A-A in FIG. 1.
Figure 3:
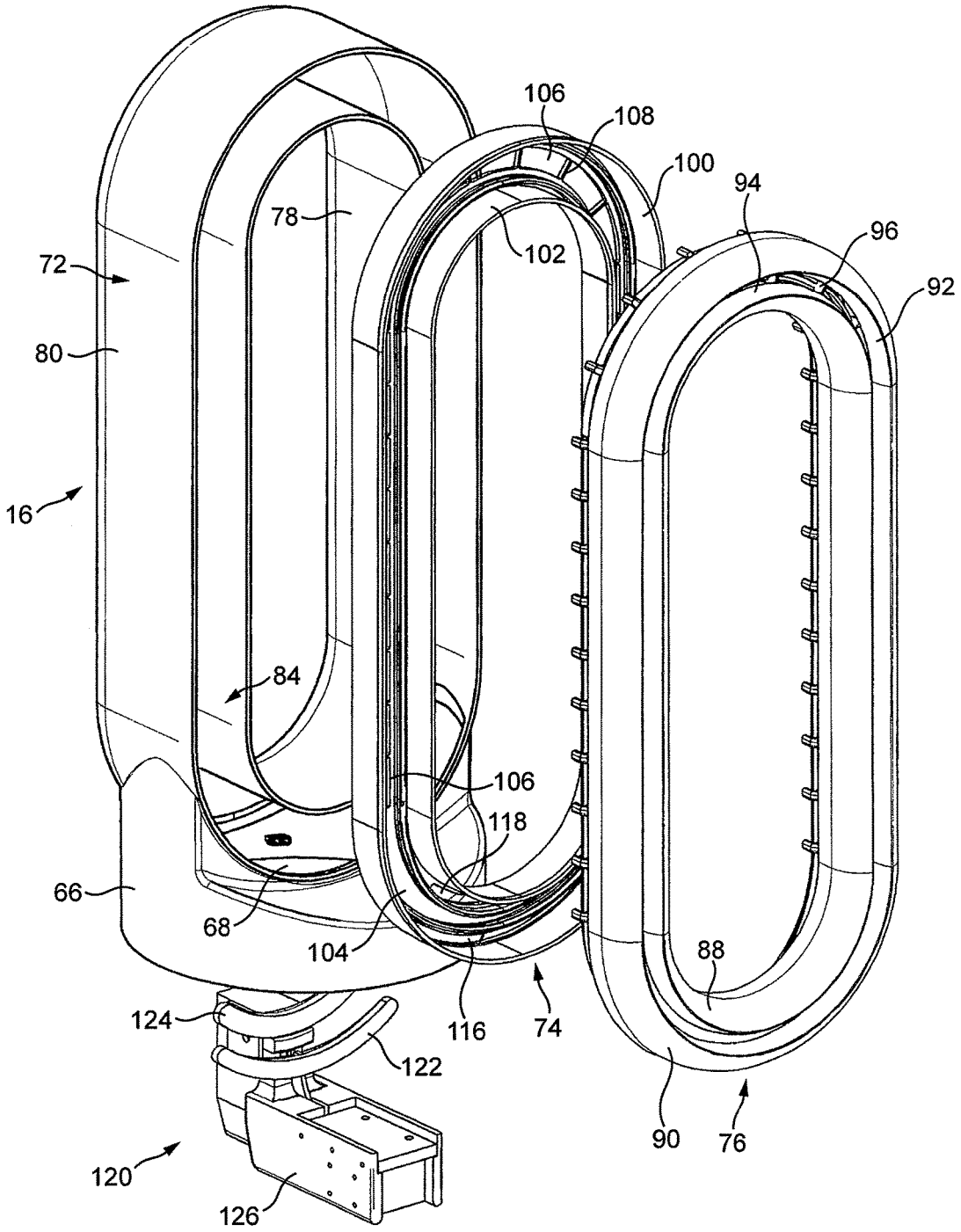
FIG. 3 is an exploded view of the nozzle of the fan assembly of FIG. 1.
Figure 4:
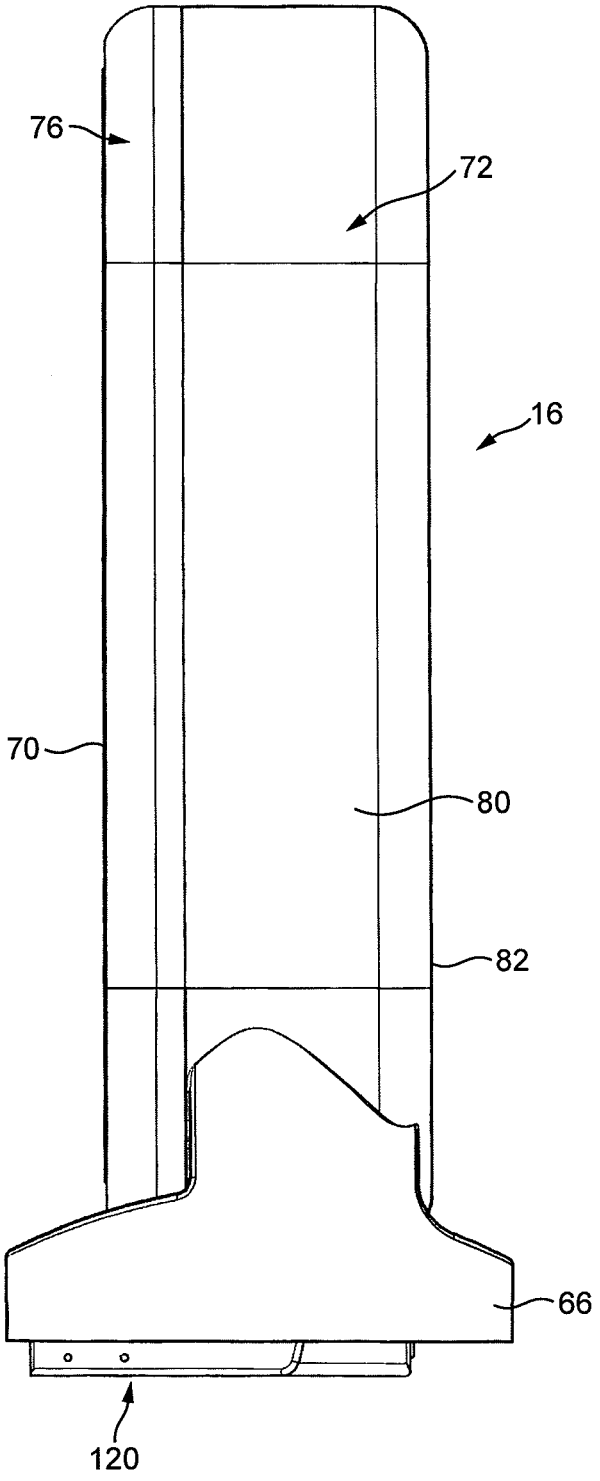
FIG. 4 is a right side view of the nozzle.

FIG. 2 illustrates a sectional view through the fan assembly 10. The lower body section 22 houses a main control circuit, indicated generally at 36, connected to the user interface control circuit 30. In response to operation of the buttons 24, 26 and the dial 28, the user interface control circuit 30 is arranged to transmit appropriate signals to the main control circuit 36 to control various operations of the fan assembly 10.

The lower body section 22 also houses a mechanism, indicated generally at 38, for oscillating the main body section 20 relative to the lower body section 22. The operation of the oscillating mechanism 38 is controlled by the main control circuit 36 in response to the user operation of the button 26. The range of each oscillation cycle of the main body section 20 relative to the lower body section 22 is preferably between 60° and 180°, and in this embodiment is around 90°. A mains power cable 39 for supplying electrical power to the fan assembly 10 extends through an aperture formed in the lower body section 22. The cable 39 is connected to a plug (not shown) for connection to a mains power supply.

The main body section 20 houses an impeller 40 for drawing the air through the air inlet 14 and into the body 12. Preferably, the impeller 40 is in the form of a mixed flow impeller. The impeller 40 is connected to a rotary shaft 42 extending outwardly from a motor 44. In this embodiment, the motor 44 is a DC brushless motor having a speed which is variable by the main control circuit 36 in response to user manipulation of the dial 28. The motor 44 is housed within a motor bucket comprising an upper portion 46 connected to a lower portion 48. The upper portion 46 of the motor bucket comprises a diffuser 50. The diffuser 50 is in the form of an annular disc having curved blades.

The motor bucket is located within, and mounted on, a generally frusto-conical impeller housing 52. The impeller housing 52 is, in turn, mounted on a plurality of angularly spaced supports 54, in this example three supports, located within and connected to the main body section 20 of the base 12. The impeller 40 and the impeller housing 52 are shaped so that the impeller 40 is in close proximity to, but does not contact, the inner surface of the impeller housing 52. A substantially annular inlet member 56 is connected to the bottom of the impeller housing 52 for guiding air into the impeller housing 52. An electrical cable 58 passes from the main control circuit 36 to the motor 44 through apertures formed in the main body section 20 and the lower body section 22 of the body 12, and in the impeller housing 52 and the motor bucket.

Preferably, the body 12 includes silencing foam for reducing noise emissions from the body 12. In this embodiment, the main body section 20 of the body 12 comprises a first annular foam member 60 located beneath the air inlet 14, and a second annular foam member 62 located between the impeller housing 52 and the inlet member 56.

With reference to FIGS. 1 to 4, the nozzle 16 has an annular shape. The nozzle 16 extends about a bore axis X to define a bore 64 of the nozzle 16. In this example, the bore 64 has a generally elongate shape, having a height (as measured in a direction extending from the upper end of the nozzle to the lower end of the nozzle 16) which is greater than the width of the nozzle 16 (as measured in a direction extending between the side walls of the nozzle 16). The nozzle 16 comprises a base 66 which is connected to the open upper end of the main body section 20 of the body 12, and which has an open lower end 68 for receiving an air flow from the body 12. As mentioned above, the nozzle 16 has an air outlet 18 for emitting an air flow from the fan assembly 10. The air outlet 18 is located towards the front end 70 of the nozzle 16, and is preferably in the form of a slot which extends about the bore axis X. The air outlet 18 preferably has a relatively constant width in the range from 0.5 to 5 mm.

The nozzle 16 comprises an annular rear casing section 72, an annular internal casing section 74 and an annular front casing section 76. The rear casing section 72 comprises the base 66 of the nozzle 16. While each casing section is illustrated here as being formed from a single component, one or more of the casing sections may be formed from a plurality of components connected together, for example using an adhesive. The rear casing section 72 has an annular inner wall 78 and an annular outer wall 80 connected to the inner wall 78 at the rear end 82 of the rear casing section 72. The inner wall 78 defines a rear portion of the bore 64 of the nozzle 16. The inner wall 78 and the outer wall 80 together define an interior passage 84 of the nozzle 16. In this example, the interior passage 84 is annular in shape, surrounding the bore 64 of the nozzle 16. The shape of the interior passage 84 thus follows closely the shape of the inner wall 78, and so has two straight sections located on opposite sides of the bore 64, an upper curved section joining the upper ends of the straight sections, and a lower curved section joining the lower ends of the straight sections. Air is emitted from the interior passage 84 through the air outlet 18. The air outlet 18 tapers towards an outlet orifice having a width $W_1$ in the range from 1 to 3 mm.

The air outlet 18 is defined by the front casing section 76 of the nozzle 16. The front casing section 76 is generally annular in shape, and has an annular inner wall 88 and an annular outer wall 90. The inner wall 88 defines a front portion of the bore 64 of the nozzle 16. The air outlet 18 is located between the inner wall 88 and the outer wall 90 of the front casing section 76.

Figure 7:
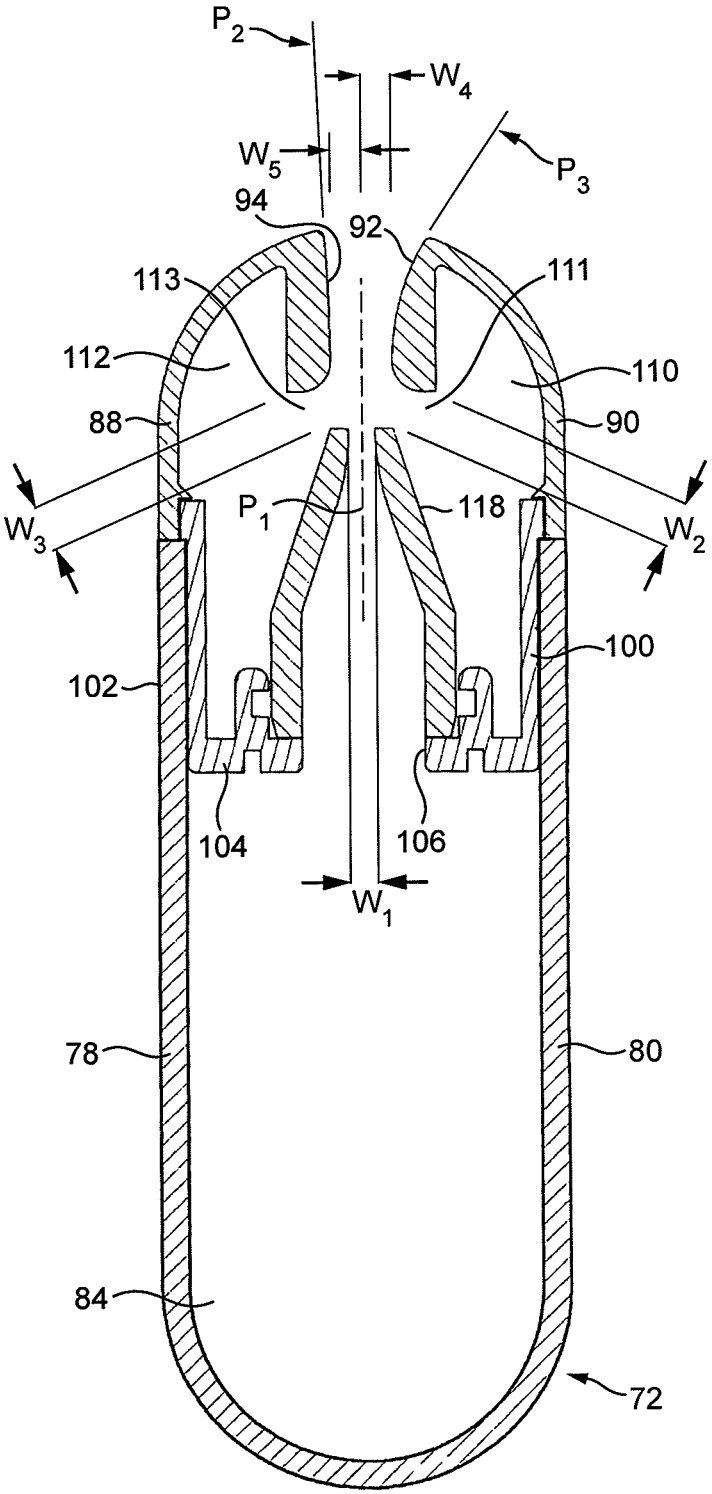
FIG. 7 is an enlarged view of the area J identified in FIG. 6.
Figure 8:
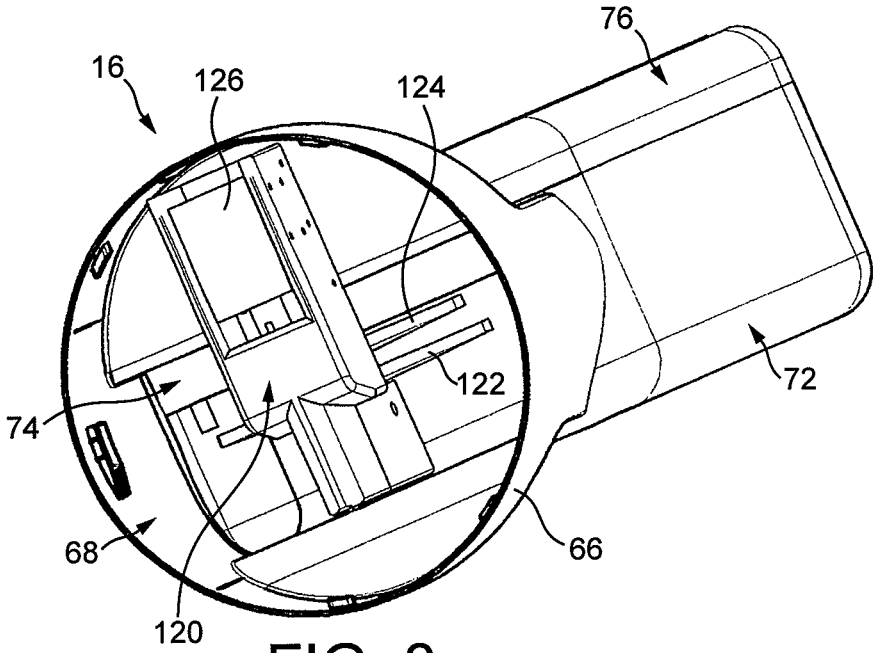
FIG. 8 is a right perspective view, from below, of the nozzle.

The air outlet 18 is located behind a first guide surface 92 which forms part of an internal surface of the outer wall 90, and a second guide surface 94 which forms part of an internal surface of the inner wall 88. The air outlet 18 is thus arranged to emit an air flow between the guide surfaces 92, 94. In this example, each guide surface 92, 94 is convex in shape, with the first guide surface 92 curving away from the bore axis X and the second guide surface 94 curving towards the bore axis X. Alternatively, each guide surface 92, 94 may be faceted. As illustrated in FIG. 7, when viewed in a cross-section along a plane passing through the bore axis X and located generally midway between the upper and lower ends of the nozzle 16, the guide surfaces 92, 94 may have different curvatures; in this example the first guide surface 92 has a higher curvature than the second guide surface 94.

A series of webs 96 connect the inner wall 88 to the outer wall 90. The webs 96 are preferably integral with both the inner wall 88 and the outer wall 90, and are around 1 mm in thickness. The webs 96 also extend from the walls 88, 90 to the air outlet 18, and across the air outlet 18, to connect the air outlet 18 to the walls 88, 90. The webs 96 can therefore also serve to guide air passing from the interior passage 84 through the air outlet 18 so that it is emitted from the nozzle 16 in a direction which is generally parallel to the bore axis X. The webs 96 can also serve to control the width of the air outlet 18. In the event that the inner wall 88 and the outer wall 90 are formed from separate components, the webs 96 may be replaced by a series of spacers located on one of the walls 88, 90 for engaging the other one of the walls 88, 90 to urge the walls apart and thereby determine the width of the air outlet 18.

Figure 5:
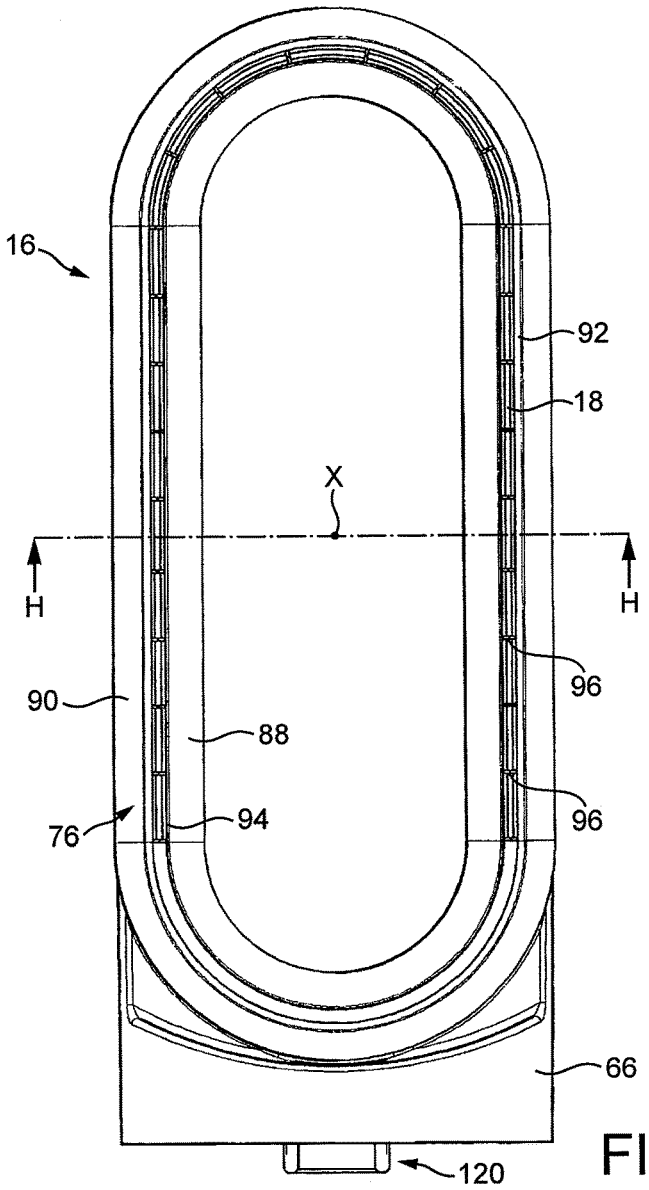
FIG. 5 is a front view of the nozzle.
Figure 6:
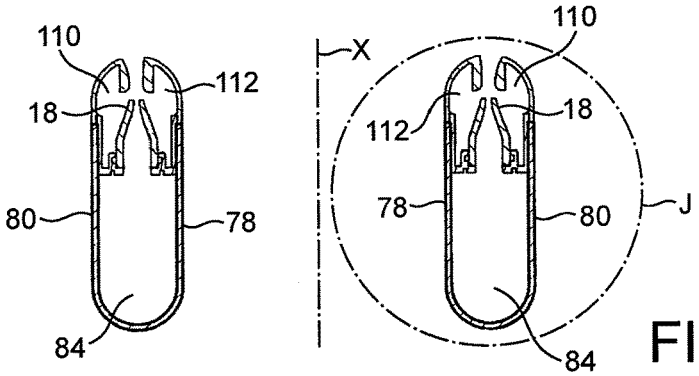
FIG. 6 is a horizontal cross-section of the nozzle, taken along line H-H in FIG. 5.

As shown in FIG. 5, in this example the air outlet 18 extends partially about the bore axis X of the nozzle 16 so as to receive air from only the straight sections and the upper curved section of the interior passage 84. The lower curved section of the front casing section 76 is shaped to form a barrier 98 which inhibits the emission of air from the lower curved section of the front casing section 76. This can allow the profile of the air flow emitted from the nozzle 16 to be more carefully controlled when the nozzle 16 has an elongate shape; otherwise there is a tendency for air to be emitted upwardly at a relatively steep angle towards the bore axis X. The barrier 98 is illustrated in FIG. 2, and has a shape in cross-section which is the same as the shape of the webs 96 arranged periodically along the length of the air outlet 18.

Figure 9:
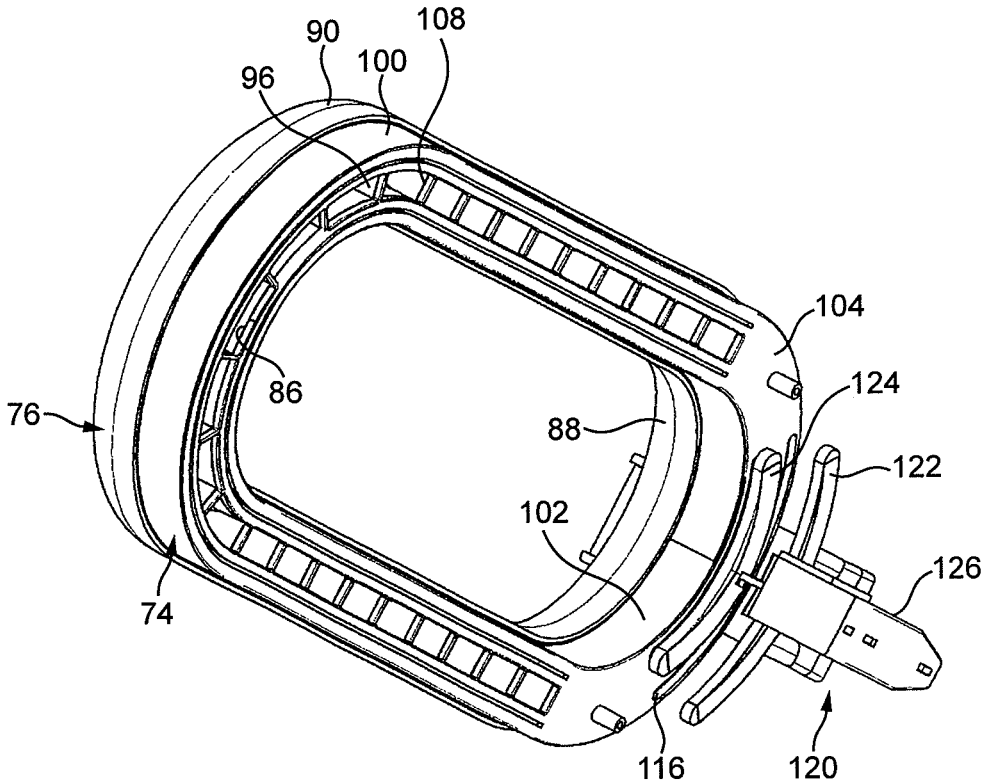
FIG. 9 is a rear perspective view, from above, of part of the nozzle, including internal and rear casing sections and a flow controller of the nozzle.
Figure 10:
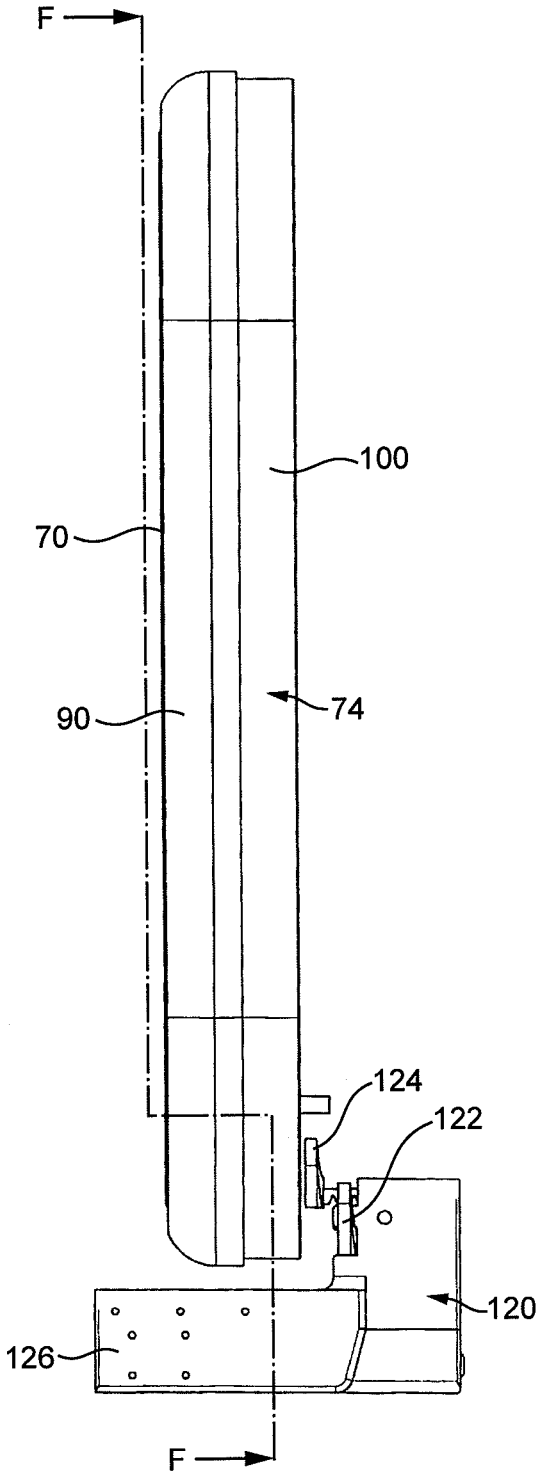
FIG. 10 is a right side view of the part of the nozzle illustrated in FIG. 9.
Figure 11:
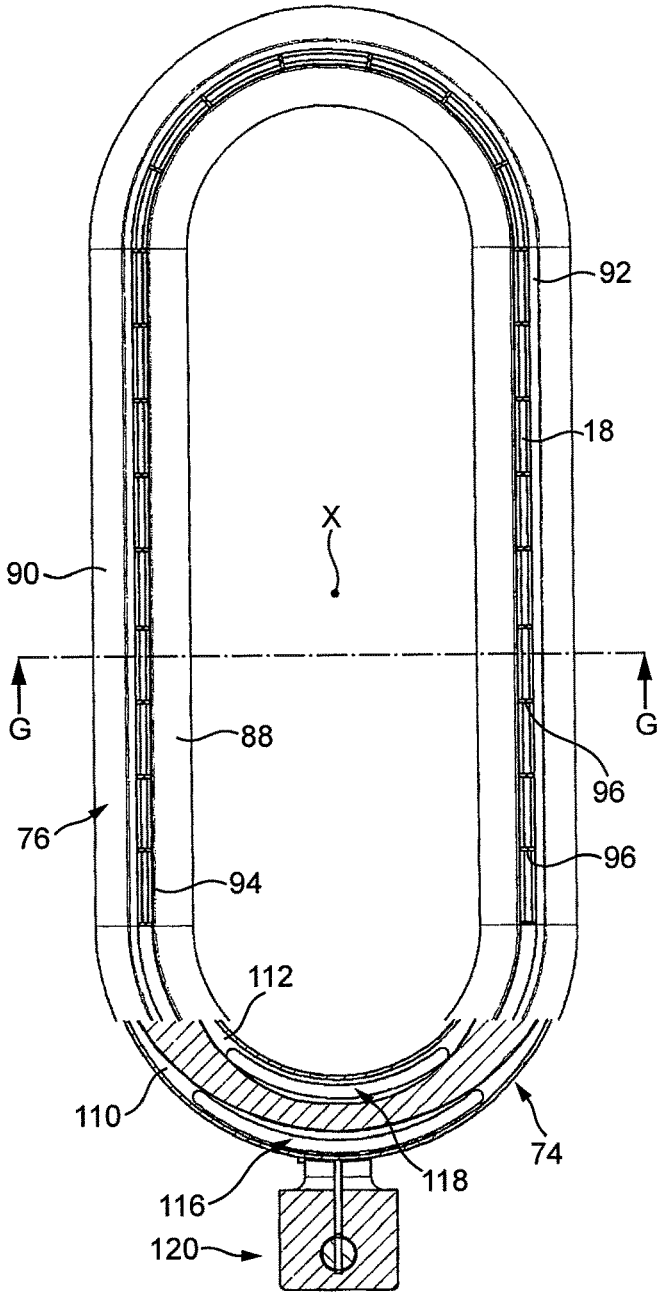
FIG. 11 is a partial vertical cross-sectional view taken along line F-F in FIG. 10.
Figure 12:
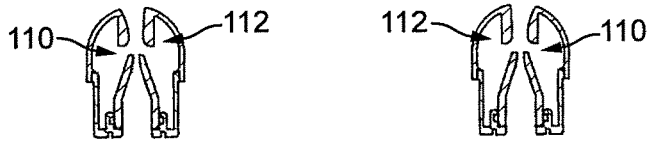
FIG. 12 is a horizontal cross-section taken along line G-G in FIG. 11.

Returning to FIG. 7, during manufacture the internal casing section 74 is inserted into the rear casing section 72. The internal casing section 74 has an annular outer wall 100 which engages the internal surface of the outer wall 80 of the rear casing section 72, and an annular inner wall 102 which engages the internal surface of the inner wall 88 of the rear casing section 72. Shoulders are formed on the front ends of the walls 100, 102 to provide stop members for restricting the insertion of the internal casing section 74 into the rear casing section 72, and which may be connected to the rear casing section 72 using an adhesive. The internal casing section 74 has a rear wall 104 extending between the rear ends of the walls 100, 102. An aperture 106 formed in the rear wall 104 allows air to pass from the interior passage 84 to the air outlet 18. Again, the aperture 106 extends partially about the bore axis X of the nozzle 16 so as to convey air to the air outlet 18 from only the straight sections and the upper curved section of the interior passage 84. Relatively short webs 108 may be arranged periodically along the length of the aperture 106 to control the width of the aperture 106. As illustrated in FIG. 9, the spacing between these webs 108 is substantially the same as the spacing between the webs 96 so that an end of each web 96 abuts an end of a respective web 108 when the internal casing section 74 is inserted fully into the rear casing section 72. The front casing section 76 is then attached to the rear casing section 72, for example using an adhesive, so that the internal casing section 74 is enclosed by the rear casing section 72 and the front casing section 76.

In addition to the interior passage 84, the nozzle 16 defines a first flow control chamber 110. The first flow control chamber 110 is annular in shape and extends about the bore 64 of the nozzle 16. The first flow control chamber 110 is bounded by the air outlet 18, the outer wall 90 of the front casing section 76, and the outer wall 100 and the rear wall 104 of the internal casing section 74. The first flow control chamber 110 is arranged to convey air to a flow control port 111 located adjacent to the first guide surface 92. The flow control port 111 is located between the air outlet 18 and the first guide surface 92, and is arranged to convey air from the first flow control chamber 110 over the first guide surface 92.

In this example, the nozzle 16 also defines a second flow control chamber 112. The second flow control chamber 112 is also annular in shape and extends about the bore 64 of the nozzle 16. The first flow control chamber 110 extends about the second flow control chamber 112. The second flow control chamber 112 is bounded by the air outlet 18, the inner wall 88 of the front casing section 76, and the inner wall 102 and the rear wall 104 of the internal casing section 74. The second flow control chamber 112 is arranged to convey air to a flow control port 113 located adjacent to the second guide surface 94. The flow control port 113 is located between the air outlet 18 and the second guide surface 94, and is arranged to convey air from the second flow control chamber 112 over the second guide surface 94.

Air enters each of the flow control chambers 110, 112 through a respective air inlet 116, 118 formed in the rear wall 104 of the internal casing section 74. As shown in FIGS. 2, 3, 9 and 11, each air inlet 116, 118 is arranged to receive air from the lower curved section of the interior passage 84.

The nozzle 16 includes a control mechanism 120 for controlling the flow of air through the flow control chambers 110, 112. In this example, the control mechanism 120 is arranged to selectively inhibit the flow of air through one of the flow control ports 111, 113 while simultaneously allowing air to flow through the other of the flow control ports 111, 113. For example, in a first state the control mechanism 120 is arranged to inhibit the flow of air through the first flow control chamber 110, whereas in a second state the control mechanism 120 is arranged to inhibit the flow of air through the second flow control chamber 112.

As shown most clearly in FIGS. 2, 3, 8 and 9, the control mechanism 120 is located mainly within the rear casing section 72 of the nozzle 16. The control mechanism 120 comprises a first valve body 122 for occluding the air inlet 116 of the first flow control chamber 110, and a second valve body 124 for occluding the air inlet 118 of the second flow control chamber 112. The control mechanism 120 also comprises an actuator 126 for moving the valve bodies 122, 124 towards and away from their respective air inlets 116, 118. In this example, the actuator 126 is a motor-driven gear arrangement. The gear arrangement is configured so that, when the motor is driven in a first direction, the first valve body 122 moves towards the rear wall 104 of the internal casing section 74 to occlude the air inlet 116 of the first flow control chamber 110 while the second valve body 124 moves away from the rear wall 104 of the internal casing section 74 to open the air inlet 118 of the second flow control chamber 112. When the motor is driven in a second direction opposite to the first direction, the first valve body 122 moves away from the rear wall 104 of the internal casing section 74 to open the air inlet 116 of the first flow control chamber 110 while the second valve body 124 moves towards from the rear wall 104 of the internal casing section 74 to occlude the air inlet 118 of the second flow control chamber 112.

The motor of the actuator 126 may be supplied with electrical power by the main control circuit 36, or by an internal power source, such as a battery. Alternatively, the gear arrangement may be manually driven. The actuator 126 may be operated by the user using a lever 128 protruding through a small aperture 130 located in the base 66 of the nozzle 16. Alternatively, the actuator 126 may be operated using an additional button located on the lower casing section 22 of the body 12 of the fan assembly 10, and/or by using a button located on the remote control. In this case, the user interface control circuit 30 may transmit an appropriate signal to the main control circuit 36 which instructs the main control circuit 36 to operate the actuator 126 to place the control mechanism 120 in a selected one of its first and second states.

To operate the fan assembly 10 the user presses button 24 of the user interface. The user interface control circuit 30 communicates this action to the main control circuit 36, in response to which the main control circuit 34 activates the motor 44 to rotate the impeller 40. The rotation of the impeller 40 causes a primary, or first, air flow to be drawn into the body 12 through the air inlet 14. The user may control the speed of the motor 44, and therefore the rate at which air is drawn into the body 12 through the air inlet 14, by manipulating the dial 28 of the user interface. Depending on the speed of the motor 44, the flow rate of an air flow generated by the impeller 40 may be between 10 and 40 liters per second. The air flow passes sequentially through the impeller housing 52 and the air outlet 23 at the open upper end of the main body portion 20 to enter the interior passage 84 of the nozzle 16.

In this example, when the fan assembly 10 is switched on the control mechanism 120 is arranged to be in a state located between the first and second states. In this state, the control mechanism 120 allows air to be conveyed through each of the air inlets 116, 118. The control mechanism 120 may be arranged to move to this state when the fan assembly 10 is switched off, so that it is automatically in this initial state when the fan assembly 10 is next switched on.

With the control mechanism in this initial state, a first portion of the air flow passes through the air inlet 116 to form a first flow control air flow which passes through the first flow control chamber 110. A second portion of the air flow passes through the air inlet 118 to form a second flow control air flow which passes through the second flow control chamber 112. A third portion of the air flow remains within the interior passage 84, wherein it is divided into two air streams which pass in opposite directions around the bore 64 of the nozzle 16. Each of these air streams enters a respective one of the two straight sections of the interior passage 84, and is conveyed in a substantially vertical direction up through each of these sections towards the upper curved section. As the air streams pass through the straight sections and the upper curved section of the interior passage 84, air is emitted through the air outlet 18.

Within the first flow control chamber 110, the first flow control air flow is divided into two air streams which also pass in opposite directions around the bore 64 of the nozzle 16. As in the interior passage 84, each of these air streams enters a respective one of the two straight sections of the first flow control chamber 110, and is conveyed in a substantially vertical direction up through each of these sections towards the upper curved section of the first flow control chamber 110. As the air streams pass through the straight sections and the upper curved section of the first flow control chamber 110, air is emitted from the first flow control port 111 adjacent, and preferably along, the first guide surface 92. Within the second flow control chamber 112, the flow control air flow is divided into two air streams which pass in opposite directions around the bore 64 of the nozzle 16. Each of these air streams enters a respective one of the two straight sections of the second flow control chamber 112, and is conveyed in a substantially vertical direction up through each of these sections towards the upper curved section. As the air streams pass through the straight sections and the upper curved section of the second flow control chamber 112, air is emitted from the flow control port 113 adjacent, and preferably along, the second guide surface 94. The flow control air flows thus merge with the air emitted from the air outlet 18 to re-combine the air flow generated by the impeller.

The air flow emitted from the air outlet 18 attaches to one of the first and second guide surfaces 92, 94. In this example, the dimensions of the nozzle 16 and the position of the air outlet 18 are selected to ensure that the air flow attaches automatically to one of the two guide surfaces when the control mechanism 120 is in its initial state. The air outlet 18 is positioned so that the minimum distance $W_2$ between the air outlet 18 and the first guide surface 92 is different from the minimum distance $W_3$ between the air outlet 18 and the second guide surface 94. The distances $W_2$, $W_3$ may take any selected size. In this example, each of these distances $W_2$, $W_3$ is also preferably in the range from 1 to 3 mm, and is substantially constant around the bore axis X. The air outlet 18 is also positioned so that one of the guide surfaces 92, 94 is located closer than the other to an imaginary curved surface $P_1$ extending about, and parallel to, the bore axis X and which passes centrally through the air outlet 18. This surface $P_1$ is indicated in FIG. 7, and generally describes the profile of air emitted from the air outlet 18. In this example, the minimum distance $W_4$ between the plane $P_1$ and the first guide surface 92 is greater than the minimum distance $W_5$ between the plane $P_1$ and the second guide surface 94.

As a result, when the fan assembly 10 is first switched on the air flow emitted from the nozzle 16 tends to attach to the second guide surface 94. The profile and the direction of the air flow as it is emitted from the nozzle 16 then depends on the shape of the second guide surface 94. As mentioned above, in this example the second guide surface 94 curves towards the bore axis X of the nozzle 16 and so the air flow is emitted from the nozzle 16 with a profile which tapers inwardly towards the bore axis X along a path indicated at $P_2$.

The emission of the air flow from the air outlet 18 causes a secondary air flow to be generated by the entrainment of air from the external environment. Air is drawn into the air flow through the bore 64 of the nozzle 16, and from the environment both around and in front of the nozzle 16. This secondary air flow combines with the air flow emitted from the nozzle 16 to produce a combined, or total, air flow, or air current, projected forward from the fan assembly 10. With the air flow tapering inwardly towards the bore axis X, the surface area of its outer profile is relatively low, which in turn results in a relatively low entrainment of air from the region in front of the nozzle 16 and a relatively low flow rate of air through the bore 64 of the nozzle 16, and so the combined air flow generated by the fan assembly 10 has a relatively low flow rate. However, for a given flow rate of a primary air flow generated by the impeller, decreasing the flow rate of the combined air flow generated by the fan assembly 10 is associated with an increase in the maximum velocity of the combined air flow experienced on a fixed plane located downstream from the nozzle. Together with the direction of the air flow towards the bore axis X, this make the combined air flow suitable for cooling rapidly a user located in front of the fan assembly.

If the actuator 126 of the control mechanism 120 is operated to place the control mechanism 120 in its first state, the second valve body 124 moves away from the rear surface 104 of the internal casing section 74 to maintain the air inlet 118 of the second flow control chamber 112 in an open state. Simultaneously, the first valve body 122 moves towards the rear surface 104 to occlude the air inlet 116 of the first flow control chamber 110. As a result, only a single portion of the air flow is diverted away from the interior passage to form a flow control air flow which passes through the second flow control chamber 112.

As discussed above, within the second flow control chamber 112, the flow control air flow is divided into two air streams which pass in opposite directions around the bore 64 of the nozzle 16. Each of these air streams enters a respective one of the two straight sections of the second flow control chamber 112, and is conveyed in a substantially vertical direction up through each of these sections towards the upper curved section. As the air streams pass through the straight sections and the upper curved section of the second flow control chamber 112, air is emitted from the flow control port 113 adjacent, and preferably along, the second guide surface 94. The flow control air flow merges with the air emitted from the air outlet 18 to re-combine the air flow. However, as the passage of the air through the flow control port 111 is inhibited by the flow control mechanism 120 a relatively low pressure is created adjacent to the first guide surface 92. The pressure differential thus created across the air flow generates a force which urges the air flow towards the first guide surface 92, which results in the air flow becoming detached from the second guide surface 94 and attached to the first guide surface 92.

As mentioned above the first guide surface 92 curves away from the bore axis X of the nozzle 16 and so the air flow is emitted from the nozzle 16 with a profile which tapers outwardly away from the bore axis X along a path indicated at $P_3$ in FIG. 7. With the air flow now tapering outwardly away from the bore axis X, the surface area of its outer profile is relatively large, which in turn results in a relatively high entrainment of air from the region in front of the nozzle 16 and so, for a given flow rate of air generated by the impeller, the combined air flow generated by the fan assembly 10 has a relatively high flow rate. Thus, placing the control mechanism 120 in its first state has the result of the fan assembly 10 generating a relatively wide flow of air through a room or an office.

If the actuator 126 of the control mechanism 120 is then operated to place the control mechanism 120 in its second state, the second valve body 124 moves towards the rear surface 104 of the internal casing section 74 to occlude the air inlet 118 of the second flow control chamber 112. Simultaneously, the first valve body 122 moves away from the rear surface 104 to open the air inlet 116 of the first flow control chamber 110. As a result, a portion of the air flow is diverted away from the interior passage to form a flow control air flow which passes through the first flow control chamber 110.

As discussed above, within the first flow control chamber 110, the flow control air flow is divided into two air streams which pass in opposite directions around the bore 64 of the nozzle 16. Each of these air streams enters a respective one of the two straight sections of the first flow control chamber 110, and is conveyed in a substantially vertical direction up through each of these sections towards the upper curved section. As the air streams pass through the straight sections and the upper curved section of the first flow control chamber 110, air is emitted from the flow control port 111 adjacent, and preferably along, the first guide surface 92. The flow control air flow merges with the air emitted from the air outlet 18 to re-combine the air flow. However, as the passage of the air through the flow control port 113 is inhibited by the flow control mechanism 120 the pressure differential across the air flow is reversed. This in turn generates a force which urges the air flow towards the second guide surface 94. This results in the air flow becoming detached from the first guide surface 92 and re-attached to the second guide surface 94.

In addition to actuating the change in the state of the control mechanism 120, the main control circuit 36 may be configured to adjust automatically the speed of the motor 44 depending on the selected state of the control mechanism 120. For example, the main control circuit 36 may be arranged to increase the speed of the motor 44 when the control mechanism 120 is placed in its first state to increase the speed of the air flow emitted from the nozzle 16, and thereby promote a more rapid cooling of the room or other location in which the fan assembly 10 is located.

Alternatively, or additionally, the main control circuit 36 may be arranged to decrease the speed of the motor 44 when the control mechanism 120 is placed in its second state to decrease the speed of the air flow emitted from the nozzle 16. This can be particularly beneficial when a heating element is located within the interior passage 84, in a manner as described in our co-pending patent application WO2010/100453, the contents of which are incorporated herein by reference. Reducing the speed of a heated air flow directed towards a user can make the fan assembly 10 suitable for use as a "spot heater" for heating a user located directly in front of the nozzle 16.

In summary, a nozzle for a fan assembly includes an air inlet, an air outlet, an interior passage for conveying air from the air inlet to the air outlet, an annular inner wall, and an outer wall extending about the inner wall. The interior passage is located between the inner wall and the outer wall. The inner wall at least partially defines a bore through which air from outside the nozzle is drawn by air emitted from the air outlet. A flow control port is located adjacent to the air outlet. A flow control chamber is provided for conveying air to the flow control port. A control mechanism selectively inhibits a flow of air through the flow control port to deflect an air flow emitted from the air outlet.

The invention claimed is:

1. A nozzle for a fan assembly, the nozzle comprising:

an air inlet;

an air outlet for emitting an air flow;

an interior passage for conveying air from the air inlet to the air outlet;

an annular inner wall;

an outer wall extending about the inner wall, the interior passage being located between the inner wall and the outer wall, the inner wall at least partially defining a bore, having a bore axis, through which air from outside the nozzle is drawn by air emitted from the air outlet;

a first guide surface and a second guide surface both located downstream from the air outlet, wherein the first guide surface is angled away from the bore axis and the second guide surface is angled towards the bore axis;

a flow control port located downstream from the air outlet;

a flow control chamber for conveying air to the flow control port, wherein the flow control chamber is located in front of the interior passage and the interior passage and the flow control chamber are separated by a wall that extends between the annular inner wall and the outer wall; and a control for selectively inhibiting a flow of air through the flow control port such that a profile of the air flow emitted from the fan assembly varies between a flow directed towards the bore axis and a flow directed away from the bore axis.

2. The nozzle of claim 1, wherein the air outlet is arranged to direct an air flow over the first guide surface or second guide surface.

3. The nozzle of claim 1, wherein the flow control port is arranged to direct an air flow over the first guide surface or second guide surface.

4. The nozzle of claim 1, wherein the first guide surface or second guide surface is curved.

5. The nozzle of claim 1, wherein the first guide surface or second guide surface is convex in shape.

6. The nozzle of claim 1, wherein the first guide surface or second guide surface extends at least partially about an axis of the bore.

7. The nozzle of claim 1, wherein the first guide surface or second guide surface surrounds an axis of the bore.

8. The nozzle of claim 1, wherein the flow control chamber is located in front of the interior passage.

9. The nozzle of claim 1, wherein the interior passage surrounds the bore of the nozzle.

10. The nozzle of claim 1, wherein the air outlet extends at least partially about the bore.

11. The nozzle of claim 1, wherein the air outlet has a curved section extending about the bore of the nozzle.

12. The nozzle of claim 1, wherein the air outlet is in the form of a slot.

13. The nozzle of claim 1, wherein the control has a first state for inhibiting the passage of air through the flow control chamber, and a second state for permitting the passage of air through the flow control chamber.

14. The nozzle of claim 1, wherein the control comprises a valve body for occluding an air inlet of the flow control chamber, and an actuator for moving the valve body relative to the air inlet.

15. The nozzle of claim 1, wherein the flow control chamber extends at least partially about the bore axis.

16. The nozzle of claim 1, wherein the flow control chamber surrounds the bore.

17. A fan assembly comprising an impeller, a motor for rotating the impeller to generate an air flow, the nozzle of claim 1 for receiving the air flow, and a controller for controlling the motor.

18. A fan assembly as claimed in claim 17, wherein the controller is arranged to adjust automatically the speed of the motor when the control is operated by a user.

* * * * *